US007100789B2

(12) United States Patent
Nguyen et al.

(10) Patent No.: US 7,100,789 B2
(45) Date of Patent: Sep. 5, 2006

(54) METALLIC BEVERAGE CAN END WITH IMPROVED CHUCK WALL AND COUNTERSINK

(75) Inventors: Tuan A. Nguyen, Golden, CO (US); Jess N. Bathurst, Fort Collins, CO (US); James A. Reed, Ballwin, MO (US); Christopher G. Neiner, Defiance, MO (US)

(73) Assignee: Ball Corporation, Broomfield, CO (US)

( * ) Notice: Subject to any disclaimer, the term of this patent is extended or adjusted under 35 U.S.C. 154(b) by 124 days.

(21) Appl. No.: 10/340,535

(22) Filed: Jan. 10, 2003

(65) Prior Publication Data

US 2003/0173367 A1 Sep. 18, 2003

Related U.S. Application Data

(63) Continuation-in-part of application No. 10/153,364, filed on May 22, 2002, now Pat. No. 6,702,142, and a continuation-in-part of application No. 09/724,637, filed on Nov. 28, 2000, now Pat. No. 6,561,004, which is a continuation-in-part of application No. 09/456,345, filed on Dec. 8, 1999, now Pat. No. 6,499,622.

(60) Provisional application No. 60/347,282, filed on Jan. 10, 2002.

(51) Int. Cl.
*B65D 41/10* (2006.01)

(52) U.S. Cl. ..... 220/623; 220/619

(58) Field of Classification Search ..... 220/619, 220/623, 624, 615, 618, 620
See application file for complete search history.

(56) References Cited

U.S. PATENT DOCUMENTS 91,754 A 6/1869 Lawernce (Continued)

FOREIGN PATENT DOCUMENTS

CH 327383 3/1958

(Continued)

OTHER PUBLICATIONS

Brewing Industry Recommended Can Specifications Manual, United States Brewers Assoc., Inc. 1983.

(Continued)

*Primary Examiner*—Nathan J. Newhouse
*Assistant Examiner*—Harry Grosso
(74) *Attorney, Agent, or Firm*—Sheridan Ross P.C.

(57) ABSTRACT

The present invention describes a beverage can end which utilizes less material and has an improved internal buckle strength based on the geometric configuration of a chuck wall, inner panel wall and central panel, and which utilizes an inwardly oriented concave arch on the chuck wall with a radius of curvature between about 0.015 inches and 0.080 inches.

13 Claims, 15 Drawing Sheets

U.S. PATENT DOCUMENTS

| | | | | |
|---|---|---|---|---|
| 163,747 | A | 5/1875 | Cummings | |
| 706,296 | A | 8/1902 | Bradley | |
| 766,604 | A | 8/1904 | Dilg | |
| 801,683 | A | 10/1905 | Penfold | |
| 818,438 | A | 4/1906 | Heindorf | |
| 868,916 | A | 10/1907 | Dieckmann | |
| 1,045,055 | A | 11/1912 | Mittinger, Jr. | |
| 2,318,603 | A | 5/1943 | Erb | |
| D141,415 | S | 5/1945 | Wargel et al. | |
| 2,759,628 | A | 8/1956 | Sokoloff | |
| 2,894,844 | A | 7/1959 | Shakman | |
| 3,023,927 | A | 3/1962 | Ehman | |
| 3,105,765 | A | 10/1963 | Creegan | |
| 3,176,872 | A | 4/1965 | Zundel | |
| 3,208,627 | A | 9/1965 | Lipske | |
| 3,251,515 | A | 5/1966 | Henchert et al. | |
| 3,268,105 | A | 8/1966 | Geiger | |
| D206,500 | S | 12/1966 | Nissen et al. | |
| 3,397,811 | A | 8/1968 | Lipske | |
| 3,417,898 | A | 12/1968 | Bozek et al. | |
| 3,480,175 | A | 11/1969 | Khoury | |
| 3,650,387 | A | 3/1972 | Hornsby et al. | |
| 3,734,338 | A | 5/1973 | Schubert | |
| 3,744,667 | A | 7/1973 | Fraze et al. | |
| D229,396 | S | 11/1973 | Zundel | |
| 3,774,801 | A | 11/1973 | Gedde | |
| 3,814,279 | A | 6/1974 | Rayzal | |
| 3,836,038 | A | 9/1974 | Cudzik | |
| 3,843,014 | A | 10/1974 | Cospen | |
| 3,874,553 | A | 4/1975 | Schultz et al. | |
| 3,904,069 | A | 9/1975 | Toukmanian | |
| 3,967,752 | A | 7/1976 | Cudzik | |
| 3,982,657 | A | 9/1976 | Keller et al. | |
| 3,983,827 | A | 10/1976 | Meadors | 113/121 |
| 4,015,744 | A | 4/1977 | Brown | |
| 4,024,981 | A | 5/1977 | Brown | |
| 4,030,631 | A | 6/1977 | Brown | |
| 4,031,837 | A | 6/1977 | Jordan | 113/121 |
| 4,037,550 | A | 7/1977 | Zofko | 220/614 |
| 4,043,168 | A | 8/1977 | Mazurek | |
| 4,093,102 | A | 6/1978 | Kraska | 220/67 |
| 4,109,599 | A | 8/1978 | Schultz | |
| 4,127,212 | A | 11/1978 | Waterbury | |
| 4,148,410 | A | 4/1979 | Brown | |
| 4,150,765 | A | 4/1979 | Mazurek | |
| 4,210,257 | A | 7/1980 | Radtke | |
| 4,213,324 | A | 7/1980 | Kelley et al. | 413/15 |
| 4,215,795 | A | 8/1980 | Elser | 220/276 |
| 4,217,843 | A | 8/1980 | Kraska | 113/121 |
| 4,271,778 | A | 6/1981 | Le Bret | 113/121 |
| 4,276,993 | A | 7/1981 | Hassegaun | |
| 4,286,728 | A | 9/1981 | Fraze et al. | |
| 4,341,321 | A | 7/1982 | Gombas | |
| 4,387,827 | A | 6/1983 | Ruemer, Jr. | 220/268 |
| 4,402,419 | A | 9/1983 | MacPherson | |
| 4,420,283 | A | 12/1983 | Post | |
| 4,434,641 | A | 3/1984 | Nguyen | |
| 4,448,322 | A | 5/1984 | Kraska | 220/67 |
| 4,467,933 | A | 8/1984 | Wilkinson et al. | |
| D279,265 | S | 6/1985 | Turner et al. | |
| 4,530,631 | A | 7/1985 | Kaminski et al. | 413/12 |
| D281,581 | S | 12/1985 | MacEwen | |
| 4,559,801 | A | 12/1985 | Smith et al. | 72/348 |
| 4,571,978 | A | 2/1986 | Taube et al. | 72/349 |
| 4,578,007 | A | 3/1986 | Diekhoff | 413/6 |
| 4,606,472 | A | 8/1986 | Taube | |
| D285,661 | S | 9/1986 | Brownbill | |
| 4,641,761 | A | 2/1987 | Smith et al. | 220/66 |
| 4,674,649 | A | 6/1987 | Pavely | |
| 4,681,238 | A | 7/1987 | Sanchez | |
| 4,685,582 | A | 8/1987 | Pulciani et al. | |
| 4,704,887 | A | 11/1987 | Bachmann et al. | |
| 4,713,958 | A | 12/1987 | Bulso, Jr. et al. | 72/348 |
| 4,715,208 | A | 12/1987 | Bulso, Jr. et al. | 72/348 |
| 4,716,755 | A | 1/1988 | Bulso, Jr. et al. | |
| 4,722,215 | A | 2/1988 | Taube et al. | |
| 4,735,863 | A | 4/1988 | Bachmann et al. | 428/579 |
| 4,790,705 | A | 12/1988 | Wilkinson et al. | 413/8 |
| 4,808,052 | A | 2/1989 | Bulso, Jr. et al. | |
| 4,809,861 | A | 3/1989 | Wilkinson | |
| D300,607 | S | 4/1989 | Ball | |
| D300,608 | S | 4/1989 | Taylor et al. | |
| 4,823,973 | A | 4/1989 | Jewitt et al. | 220/67 |
| 4,832,236 | A | 5/1989 | Greaves | |
| 4,865,506 | A | 9/1989 | Kaminski | |
| D304,302 | S | 10/1989 | Dalli et al. | |
| 4,890,759 | A | 1/1990 | Scanga et al. | |
| 4,893,725 | A | 1/1990 | Ball | |
| 4,895,012 | A | 1/1990 | Cook et al. | |
| 4,919,294 | A | 4/1990 | Kawamoto | |
| RE33,217 | E | 5/1990 | Nguyen | 220/66 |
| 4,930,658 | A | 6/1990 | McEldowney | 220/269 |
| 4,934,168 | A | 6/1990 | Osmanski et al. | |
| 4,955,223 | A | 9/1990 | Stodd et al. | 72/336 |
| 4,967,538 | A | 11/1990 | Leftault, Jr. et al. | |
| 4,991,735 | A | 2/1991 | Biondich | 220/600 |
| 4,994,009 | A | 2/1991 | McEldowney | 493/14 |
| 5,027,580 | A | 7/1991 | Hymes et al. | 413/27 |
| 5,042,284 | A | 8/1991 | Stodd et al. | |
| 5,046,637 | A | 9/1991 | Kysh | 220/610 |
| 5,064,087 | A | 11/1991 | Koch | |
| 5,066,184 | A | 11/1991 | Taura et al. | 413/4 |
| 5,129,541 | A | 7/1992 | Voigt et al. | |
| 5,143,504 | A | 9/1992 | Braakman | 413/6 |
| 5,145,086 | A | 9/1992 | Krause | |
| 5,149,238 | A | 9/1992 | McEldowney et al. | |
| D337,521 | S | 7/1993 | McNulty | |
| 5,289,938 | A | 3/1994 | Sanchez | |
| D347,172 | S | 5/1994 | Heynan et al. | |
| 5,309,749 | A | 5/1994 | Stodd | 72/336 |
| 5,320,469 | A | 6/1994 | Katou et al. | 413/27 |
| 5,356,256 | A | 10/1994 | Turner et al. | 413/8 |
| D352,898 | S | 11/1994 | Vacher | |
| 5,381,683 | A | 1/1995 | Cowling | 72/329 |
| D356,498 | S | 3/1995 | Strawser | |
| 5,494,184 | A | 2/1996 | Noguchi et al. | 220/269 |
| 5,502,995 | A | 4/1996 | Stodd | 72/336 |
| 5,527,143 | A | 6/1996 | Turner et al. | 413/8 |
| 5,582,319 | A | 12/1996 | Heyes et al. | |
| 5,590,807 | A | 1/1997 | Forrest et al. | 220/608 |
| 5,598,734 | A | 2/1997 | Forrest et al. | 72/348 |
| 5,634,366 | A | 6/1997 | Stodd | |
| 5,636,761 | A | 6/1997 | Diamond et al. | |
| 5,653,355 | A | 8/1997 | Tominaga et al. | |
| 5,685,189 | A | 11/1997 | Nguyen et al. | 72/348 |
| 5,829,623 | A | 11/1998 | Otsuka et al. | |
| 5,857,374 | A | 1/1999 | Stodd | |
| D406,236 | S | 3/1999 | Brifcani et al. | |
| 5,911,551 | A | 6/1999 | Moran | 413/31 |
| 5,950,858 | A | 9/1999 | Sergeant | |
| 5,969,605 | A | 10/1999 | McIntyre et al. | 209/549 |
| 6,065,634 | A * | 5/2000 | Brifcani et al. | 220/619 |
| 6,089,072 | A | 7/2000 | Fields | |
| 6,102,243 | A | 8/2000 | Fields et al. | |
| 6,126,034 | A | 10/2000 | Borden et al. | 220/671 |
| 6,131,761 | A | 10/2000 | Cheng et al. | |
| D452,155 | S | 12/2001 | Stodd | |
| 6,419,110 | B1 * | 7/2002 | Stodd | 220/623 |
| 6,460,723 | B1 | 10/2002 | Nguyen et al. | 220/619 |
| 6,499,622 | B1 | 12/2002 | Neiner | 220/619 |
| 6,702,142 | B1 | 12/2002 | Neiner | |
| 6,516,968 | B1 | 2/2003 | Stodd | |
| 6,561,004 | B1 | 5/2003 | Neiner et al. | 72/715 |
| 6,748,789 | B1 * | 6/2004 | Turner et al. | 72/379.4 |

| | | | |
|---|---|---|---|
| 6,877,941 | B1 | 7/2004 | Brifcani et al. |
| 6,848,875 | B1 | 2/2005 | Brifcani et al. |
| 2002/0190071 | A1 | 12/2002 | Neiner |
| 2004/0140312 | A1 | 7/2004 | Neiner |

FOREIGN PATENT DOCUMENTS

| | | |
|---|---|---|
| DE | 734942 | 5/1943 |
| DE | G 92 11 788 | 2/1993 |
| EP | 0 139 282 | 5/1985 |
| EP | 153115 A3 | 8/1985 |
| EP | 0 340 955 | 11/1989 |
| FR | 917771 | 1/1947 |
| GB | 2 196 891 | 5/1988 |
| GB | 2218024 | 11/1989 |
| GB | 2 315 478 | 11/1996 |
| JP | 49-096887 | 9/1974 |
| JP | 50-144580 | 11/1975 |
| JP | 54-074184 | 6/1979 |
| JP | 55-122945 | 2/1980 |
| JP | S57-117323 | 1/1981 |
| JP | 56-053835 | 5/1981 |
| JP | 56-053836 | 5/1981 |
| JP | 57-044435 | 3/1982 |
| JP | 57-094436 | 6/1982 |
| JP | 58-035028 | 3/1983 |
| JP | 58-035029 | 3/1983 |
| JP | 59-144535 | 8/1984 |
| JP | 61-023533 | 2/1986 |
| JP | 63-125152 | 5/1988 |
| JP | 1-167050 | 6/1989 |
| JP | 01-170538 | 7/1989 |
| JP | 01-289526 | 11/1989 |
| JP | 02-092426 | 4/1990 |
| JP | 2-192837 | 7/1990 |
| JP | 02-131931 | 11/1990 |
| JP | 03-032835 | 2/1991 |
| JP | 3275443 | 12/1991 |
| JP | 5-32255 | 2/1993 |
| JP | H5-112357 | 5/1993 |
| JP | 5 185170 | 7/1993 |
| JP | 6-127547 | 5/1994 |
| JP | 6-179445 | 6/1994 |
| JP | 07-171645 | 7/1995 |
| JP | 08-168837 | 7/1996 |
| JP | 08-192840 | 7/1996 |
| JP | 2000-109068 | 4/2000 |
| NL | 62179828 | 7/1962 |
| WO | 8910216 | 11/1989 |
| WO | 93/17864 | 9/1993 |
| WO | 96/37414 | 11/1996 |
| WO | 98/34743 | 8/1998 |
| WO | 00/12243 | 3/2000 |
| WO | 5032953 | 4/2005 |

OTHER PUBLICATIONS

Guideline Booklet of the Society of Soft Drink Technologists, Jun. 5, 1986.

Beverage Can, End, & Double Seam Dimensional Specifications, Society of Soft Drink Technologists, Aug. 1993.

* cited by examiner

Standard 202 Diameter

202 Diameter Super End

BEFORE DOUBLE SEAMING

AFTER DOUBLE SEAMING

METALLIC BEVERAGE CAN END WITH IMPROVED CHUCK WALL AND COUNTERSINK

The present invention claims priority of U.S. Provisional Patent Application Ser. No. 60/347282, filed on Jan. 10, 2002, and is a Continuation-In-Part Application of U.S. patent application Ser. No. 10/153,364, filed on May 22, 2002, which is now issued U.S. Pat. No. 6,702,142, which was a Continuation Application of U.S. patent application Ser. No. 09/456,345, filed Dec. 8, 1999, which is now issued U.S. Pat. No. 6,499,622. The present invention is also a Continuation-In-Part Application of U.S. patent application Ser. No. 09/724,637, filed Nov. 28, 2000, which is now issued U.S. Pat. No. 6,561,004, which was a Continuation-In-Part Application of U.S. patent application Ser. No. 09/456,345, which is now issued U.S. Pat. No. 6,499,622. Each of these named applications or issued patents is incorporated herein in their entirety by reference.

FIELD OF THE INVENTION

The present invention generally relates to containers and container end closures, and more specifically metallic beverage can end closures adapted for interconnection to a beverage can body.

BACKGROUND OF THE INVENTION

Containers and more specifically metallic beverage containers are typically manufactured by interconnecting a beverage can end closure on a beverage container body. In some applications, an end closure may be interconnected on both a top side and a bottom side of a can body. More frequently, however, a beverage can end closure is interconnected on a top end of a beverage can body which is drawn and ironed from a flat sheet of blank material such as aluminum. Due to the potentially high internal pressures generated by carbonated beverages, both the beverage can body and the beverage can end closure are typically required to sustain internal pressures exceeding 90 psi without catastrophic and permanent deformation. Further, depending on various environmental conditions such as heat, over fill, high CO2 content, and vibration, the internal pressure in a typical beverage can may at times exceed 100 psi.

Thus, beverage can bodies and end closures must be durable to withstand high internal pressures, yet manufactured with extremely thin and durable materials such as aluminum to decrease the overall cost of the manufacturing process and the weight of the finished product. Accordingly, there exists a significant need for a durable beverage can end closure which can withstand the high internal pressures created by carbonated beverages, and the external forces applied during shipping, yet which is made from durable, lightweight and extremely thin metallic materials with geometric configurations which reduce material requirements. Previous attempts have been made to provide beverage can ends with unique geometric configuration in an attempt to provide material savings and improve strength. One example of such a beverage can end is defined in U.S. Pat. No. 6,065,634 To Crown Cork and Seal Technology Corporation, entitled "Can End and Method for Fixing the Same to a Can Body" (hereinafter the '634 Patent) and depicted as prior art in FIG. 2. In the beverage can end described in the '634 Patent, a chuck wall is provided which is inclined inwardly toward a countersink at an angle of between about 40° and 60°. The beverage can end closure described in the '634 Patent does not utilize standard double seaming processes which are well known in the industry.

Other patents have attempted to improve the strength of container end closures and save material costs by improving the geometry of the countersink region. Examples of these patents are U.S. Pat. No. 5,685,189 and U.S. Pat. No. 6,460,723 to Nguyen et al, which are incorporated herein in their entirety by reference. Another pending application which addresses the manufacturing processes utilized to produce various embodiments of the end closure of the present invention is described in pending U.S. patent application Ser. No. 10/107,941, which was filed on Mar. 27, 2002 and is further incorporated herein in its entirety by reference.

The following disclosure describes an improved container end closure which is adapted for interconnection to a container body and which has an improved countersink, chuck wall geometry, and unit depth which significantly saves material costs, yet can withstand significant internal pressures.

SUMMARY OF THE INVENTION

Thus, in one aspect of the present invention, a container end closure is provided which can withstand significant internal pressures approaching 100 psi, yet saves between 3% and 10% of the material costs associated with manufacturing a typical beverage can end closure. Although the invention described herein generally applies to beverage containers and beverage end closures used to contain beer, soda and other carbonated beverages, it should be appreciated by one skilled in the art that the invention may also be used for any type of container and container end closures. In one embodiment of the present invention, these attributes are achieved by providing a chuck wall with a concave "arch", and a reduced countersink depth, wherein the countersink is positioned no greater than about 0.095 inches from the height of the central panel, and more preferably no greater than about 0.090 inches.

In another aspect of the present invention, a container end closure is provided which is manufactured with conventional manufacturing equipment and thus generally eliminates the need for expensive new equipment required to make the beverage can container end closure. Thus, existing and well known manufacturing equipment and processes can be implemented to quickly and effectively initiate the production of an improved beverage can container end closure in an existing manufacturing facility, i.e., can plant.

It is another aspect of the present invention to provide an end closure with an "arcuate," non-linear shaped chuck wall. As used in the prior art, the term "chuck wall" generally refers to the portion of the end closure located between the countersink and the circular end wall (or peripheral curl or peripheral flange that forms the seam with the can body) and which is contacted by or engaged with the chuck during seaming, as shown in FIG. 7 of the Crown '634 patent. Unlike the prior art, the seaming chuck used in seaming the lids of the present invention does not necessarily contact or engage with the entire seaming chuck wall during seaming. Points of engagement for the chuck in the current invention are apparent in the drawings and detailed description below.

In another aspect of the present invention, a method for forming a beverage can end closure is provided, wherein a can end closure is provided with a countersink radius of no greater than 0.015 inches, and which is generally positioned at a depth no greater than about 0.095 inches from the central panel. Preferably, the central panel is raised no more than about 0.090 inches from the lowermost portion of the countersink.

More specifically, the method of manufacturing generally comprises two processes including a multiple step and a single step. The multiple step produces a "pre-shell" which is formed and moved to another operation for final forming. In this procedure, the "pre-shell" is captured between two opposing tools, where a clamping function occurs prior to panel and countersink forming. The countersink form is achieved through compression verses drawing between a male and female tool group. The single step process produces a drawn flat bottom cup as the male tool enters a female tool. Within the female tool is a tool "panel punch" which is under high pressure and clamps the flat bottom cup against the male punch during entrance and exit of the female tool. The panel and countersink are formed as the male tool withdraws from the female tool. The "panel punch" tool follows the male tool. The "panel punch" tool has the panel and countersink form geometry within its contour. This action forms the panel with the cup bottom wrapping around it's contour and the countersink is formed within the clearance provided between the female and panel punch compressing the bottom of the countersink.

It is another aspect of the present invention to provide a beverage can end closure which saves material costs by reducing the size of the blank material and/or utilizing thinner materials which have improved aluminum alloy properties. Thus, the integrity and strength of the beverage can end closure is not compromised, while material costs are significantly reduced as a result of the blank reduction, and/or improved aluminum alloy properties provided therein.

It is a further aspect of the present invention to provide a beverage can container end closure with an upper chuck wall having a first radius of curvature "Rc1", and a lower chuck wall having a second radius of curvature "Rc". A central chuck wall portion has yet another radius of curvature "Rc2" which defines an outwardly oriented, concave "arch" which is positioned between the upper chuck wall and lower chuck wall. Alternatively, the upper and lower chuck wall may be substantially "curvilinear," and thus having such a moderate degree of curvature that it resembles a straight line, i.e., linear. Further, the unit depth between an uppermost portion of a circular end wall and a lowermost portion of the countersink has a dimension in one embodiment of between about 0.215 and 0.280 inches, and more preferably about 0.250–0.260 inches. Further, in one aspect of the present invention, the inner panel wall may additionally have a non-linear radius of curvature, which is preferably about 0.050 inches.

It is yet a further aspect of the present invention to reduce the distance between the inner and outer panel walls of the countersink, and to thus save material costs while additionally improving the strength of the end closure. Thus, in one embodiment of the present invention the distance between the inner and outer panel walls is between about 0.045 inches and 0.055 inches, and more preferably about 0.052 inches.

It is yet another aspect of the present invention to provide an end closure with a chuck wall with superior strength compared to a conventional container end closure and which can withstand significant internal pressure. Thus, in one embodiment of the present invention an end closure is provided with a chuck wall having an outwardly projecting concave arch, and which in one embodiment is positioned approximately mid-way between the countersink and the circular end wall prior to double seaming the can end to a container body. Preferably, the central chuck wall arch has a radius of curvature between about 0.020 inches and 0.080, and more preferably less than about 0.040 inches, and more preferably between 0.020–0.025 inches. In one embodiment, the upper chuck wall and lower chuck wall may be substantially linear, or have only a gradual radius of curvature.

Thus, in one aspect of the present invention, a metallic container end closure adapted for interconnection to a container body is provided, and comprises:

- a circular end wall adapted for interconnection to a side wall of a container body;
- a chuck wall integrally interconnected to said circular end wall and extending downwardly at an angle $\theta$ of at least about 8 degrees as measured from a vertical plane, said chuck wall further comprising an inwardly extending arch having a radius of curvature of between about 0.020 and 0.080 inches with a center point below said circular end wall;
- a countersink interconnected to a lower portion of said chuck wall and having a radius of curvature less than about 0.015 inches;
- an inner panel wall interconnected to said countersink and extending upwardly at an angle $\phi$ of between about 0 degrees and 15 degrees as measured from a substantially vertical plane;
- a central panel interconnected to an upper end of said inner panel wall and raised above a lowermost portion of said countersink at least about 0.080 inches.

DETAILED DESCRIPTION

Figure 1:
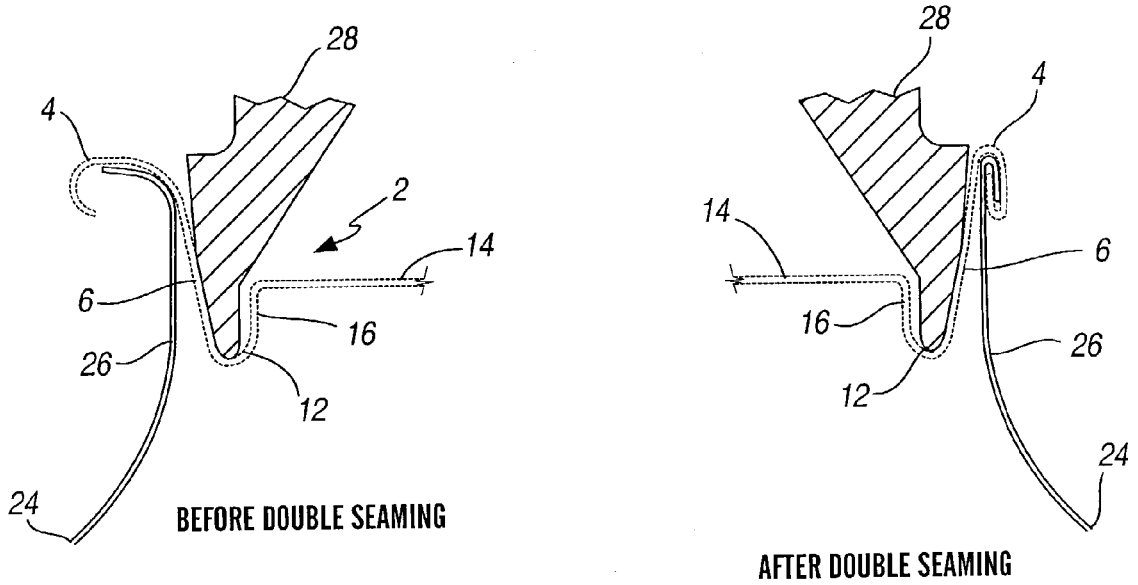
FIG. 1 (Prior Art)
FIG. 1 is a cross-sectional front elevation view of a standard 202 diameter beverage can end closure positioned before and after double seaming to a beverage can body.

Referring now to FIGS. 1–7B, cross-sectional front elevation views are provided of prior art beverage can ends (FIGS. 1–2A) and various embodiments of the present invention. (FIGS. 3–7B) More specifically, a metallic beverage can end 2 is described herein which is generally comprised of a circular end wall 4, a chuck wall 6, a countersink 12, a central panel 14, and an inner panel wall 16 which interconnects the central panel 14 to the countersink 12. The chuck wall 6 may additionally be comprised of an upper chuck wall 8 and lower chuck wall 10 which in some embodiments may have a first radius of curvature Rc1, and a second radius of curvature Rc2, respectively. In some embodiments, the inner panel wall 16 may additionally be comprised of an inner panel wall upper end 18 and an inner panel wall lower end 20. Further, the top portion of the circular end wall 4 is defined by what is typically referred to in the beverage can art as a crown 22.

The chuck wall angle $\theta_1$ is defined herein as an angle diverging from a vertical plane as the chuck wall 6 extends downwardly toward a countersink 12. In various embodiments with an upper chuck wall 8 and a lower chuck wall 10 there may be lower chuck wall angle $\theta_2$, which is defined and used herein as the divergence from an imaginary vertical plane of the lower chuck wall 10. Thus, in some embodiments of the present invention there may be an upper chuck wall 8, a lower chuck wall 10 and a corresponding upper chuck wall angle $\theta_1$ and a lower chuck wall angle $\theta_2$.

Alternatively, where the upper chuck wall 8 and lower chuck wall 10 are comprised of substantially non-linear components, there may be a first radius of curvature Rc1 associated with the upper chuck wall 8, and a second radius of curvature Rc2 associated with the lower chuck wall 10. The pronounced chuck wall arch 30 has a radius of curvature which is defined herein and generally depicted in the drawings as "Rc." As used herein, the term "inwardly" refers to a direction oriented toward the interior portion of the end closure, i.e., a central most portion of the central panel 14, while the term "outwardly" refers to a direction oriented toward the outer edge of the container body, the circular end wall 4 or double seam 32.

Additionally, an inner panel wall 16 typically interconnects a lowermost portion of a countersink 12 with the central panel 14, and is typically oriented at an angle $\phi_1$ which is shown in the drawings, and further represents an angle extending from an imaginary vertical plane. In some embodiments, a lower inner panel wall angle $\phi_2$ may additionally be present, and which defines the angle extending from an imaginary vertical plane of the lower inner panel wall.

Referring now to FIG. 1, a front cross-sectional view of a prior art 202 diameter beverage can end is shown positioned with respect to a beverage can body just prior to double seaming and after double seaming. As identified in the left hand portion of the drawing, the beverage can end 2 is positioned with the circular end wall 4 juxtapositioned over a beverage can neck 26, with a seaming chuck 28 used during manufacturing positioned along the chuck wall 6 and extending downward into the countersink 12. As shown in the drawing on the right side of FIG. 1, the beverage can end 2 has now been double seamed, wherein the circular end wall 4 is interconnected to an upper portion of the beverage can neck to provide a sealing engagement between the beverage can end 2 and the beverage can body 24. It is additionally noted that in a typical 202 diameter beverage can end, the chuck wall 6 is oriented at only a moderate angle, i.e., 2–8° with respect to the substantially vertical beverage can neck, and has an inward oriented angle of between 1°–6° after double seaming.

Figure 2:
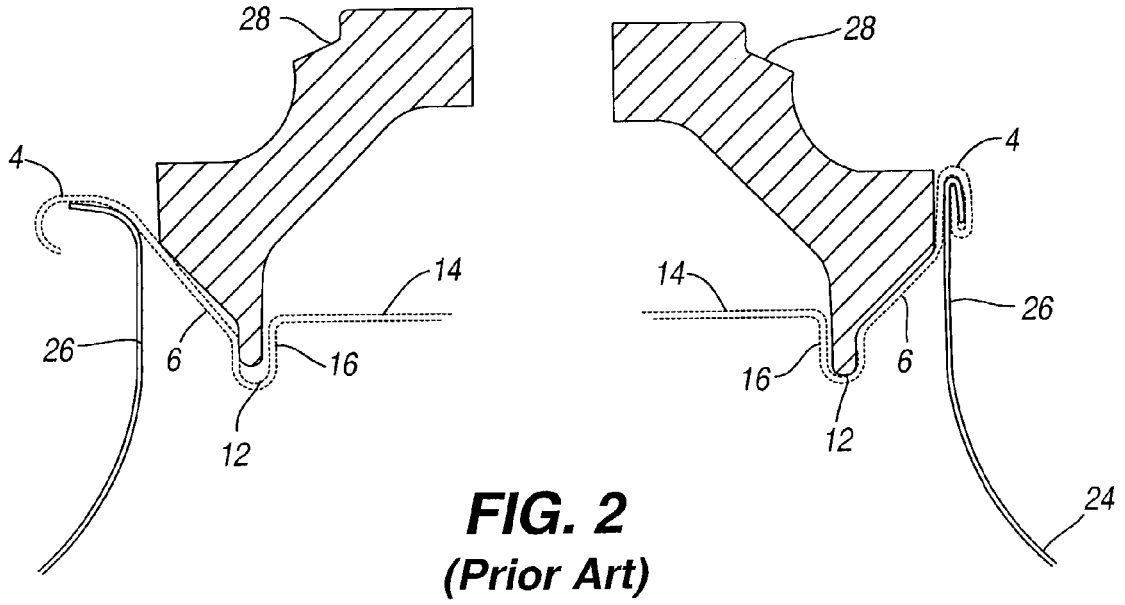
FIG. 2 (Prior Art)
FIG. 2 is a cross-sectional front elevation view of another prior art beverage can end positioned before and after double seaming to a beverage can body.

Referring now to FIG. 2, a prior art beverage can end described in the '634 patent is shown, and which is further incorporated herein by reference. More specifically, on the left hand portion of the drawing, the beverage can end is shown just prior to double seaming, while on the right hand portion of the drawing the beverage can end 2 has been double seamed to the beverage can neck 26. In this prior art example, the chuck wall is substantially linear, yet has a pronounced angle of between about 40° and 60° extending inwardly as measured from a substantially vertical beverage can neck 26. Furthermore, the countersink 12 is interconnected to an inner panel wall 16 which is substantially linear and extending substantially upward to the point of interconnection with the central panel 14. Unfortunately, due to the pronounced chuck wall angle which extends to the circular end wall 4, this type of configuration has not proven to be overly reliable during high speed manufacturing. Furthermore, it should be noted that during double seaming the seaming chuck 28 is in contact with the chuck wall 6 along the entire length of the chuck wall 6 between the countersink 12 and circular end wall.

Figure 2A:
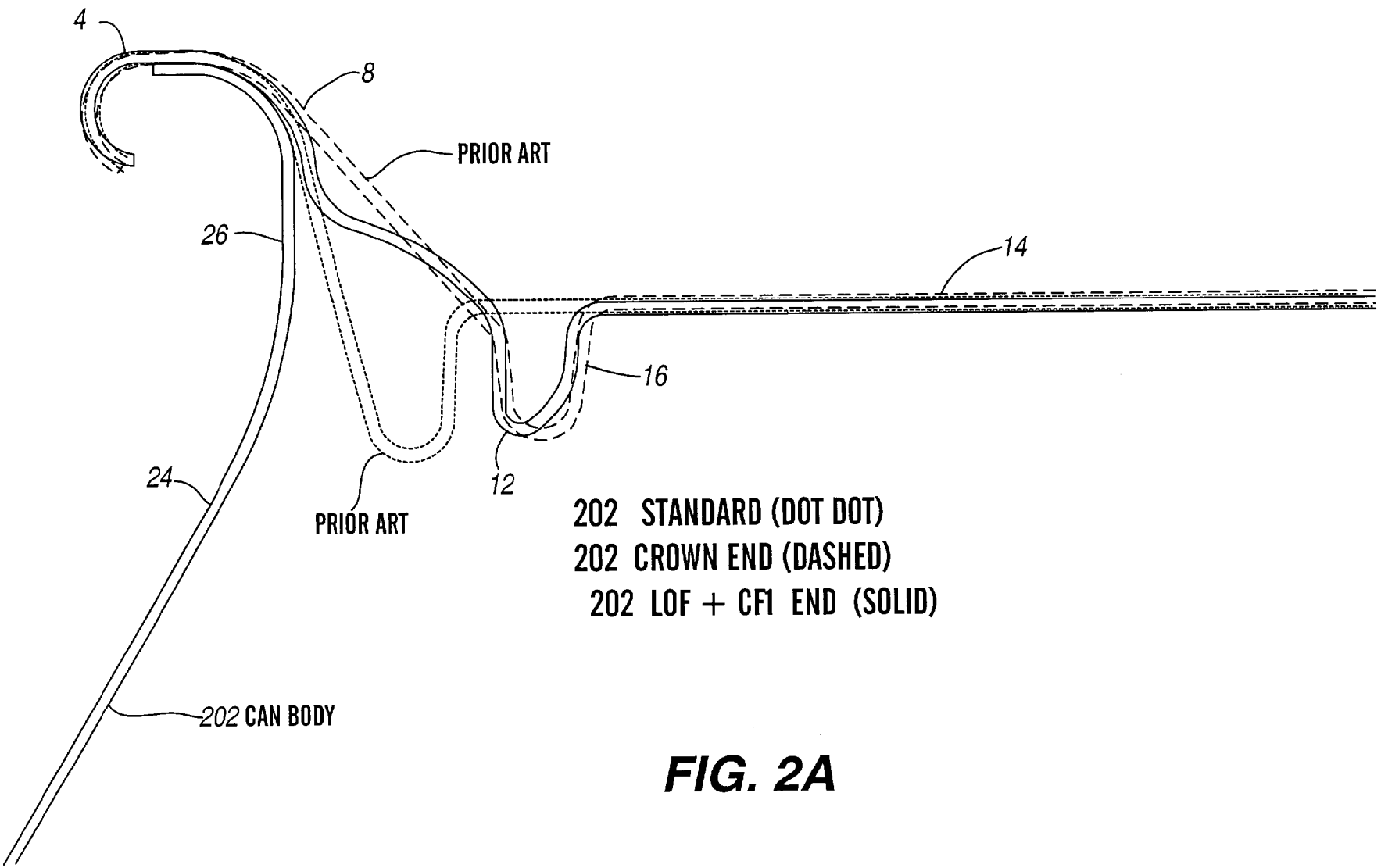
FIG. 2A is a cross-sectional front elevation view of two prior art beverage can ends transposed over one embodiment of the present invention to identify the distinctions therein.

Referring now to FIG. 2A, a cross-sectional front elevation view of a standard 202 beverage can end, the beverage can end disclosed in the '634 patent, and one embodiment of the present invention are shown transposed on top of one another for reference purposes.

In this drawing, the distinctions in the upper chuck wall of these three ends are readily apparent. More specifically, the upper end of the chuck wall on the end described in the '634 patent diverges inwardly at a very high angle of between 40–60 degrees, which creates significant separation between the upper chuck wall and neck of the can body as opposed to a standard 202 can end and consistent with the can end described in various embodiments of the present invention. As stated above, this distinction becomes problematic while double seaming the can end 2 to the neck 26 of the can body, where more metal movement is required in seaming the beverage can end disclosed in the '634 patent, as opposed to the reliable, time tested double seaming obtained with a standard 202 can end. As seen in FIG. 2A, the present invention utilizes an upper chuck wall angle with a geometric configuration which is similar to a conventional 202 can end, and thus eliminates the need for equipment modifications and the inherent double seaming problems associated with prior art beverage cans which utilize an upper chuck wall 8 with a high inward angle as measured from an imaginary vertical plane.

Figure 3:
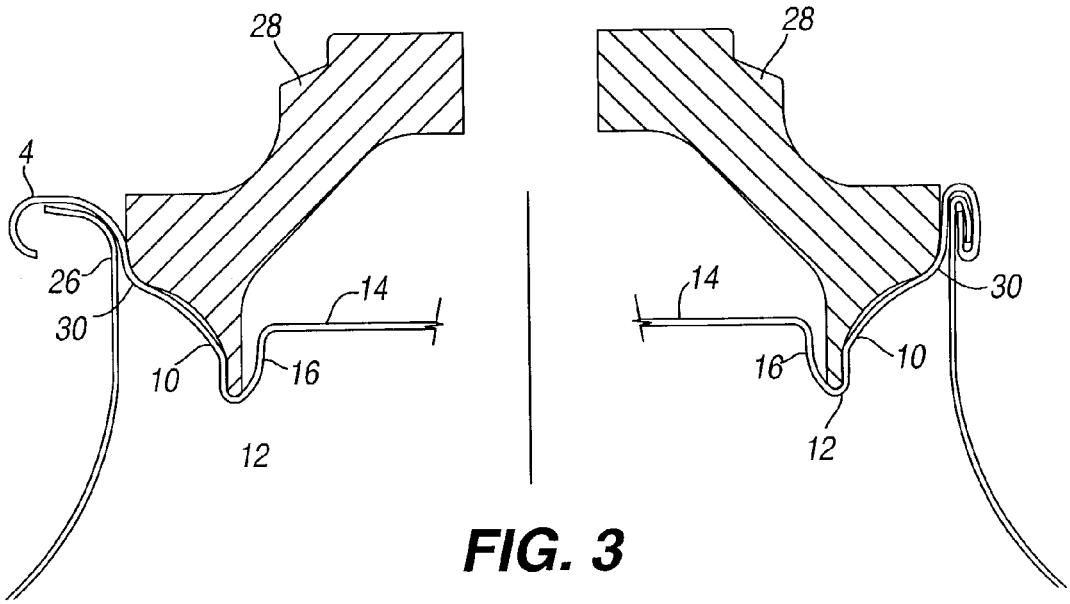
FIG. 3 is a cross-sectional front elevation view of one embodiment of the present invention positioned before and after double seaming to a beverage can body.

Referring now to FIG. 3, one embodiment of the present invention is shown herein with the beverage can end 2 positioned just prior to double seaming as shown on the left hand side of FIG. 3, and the beverage can end 2 shown just after double seaming as shown on the right hand side of the drawing. As identified in FIG. 3, the chuck wall 10 has an arcuate shape which extends upward and inwardly, while the upper chuck wall has a concave arch 30 which extends outwardly towards the beverage can neck 26, and which has a specific radius of curvature Rc. Further, it should be noted that the seaming chuck 28 only contacts certain portions of the end closure between the countersink 12 and circular end wall 4. As shown after double seaming, a center portion of the arch 30 is positioned below the lower most portion of the double seam, which has been shown to help prevent the possibility of leaking after filling the container and double seaming to the end closure. A lower chuck wall is shown in this drawing at 10 which has an independent radius of curvature Rc2. As further shown in the drawings, a lowermost portion of the lower chuck wall 10 interconnects to the countersink 12, which is further interconnected to an inner panel wall 16 which extends upwardly and interconnects to a central panel 14. As shown in this embodiment of the present invention, the inner panel wall 16 may additionally have a non-linear shape.

Figure 3A:
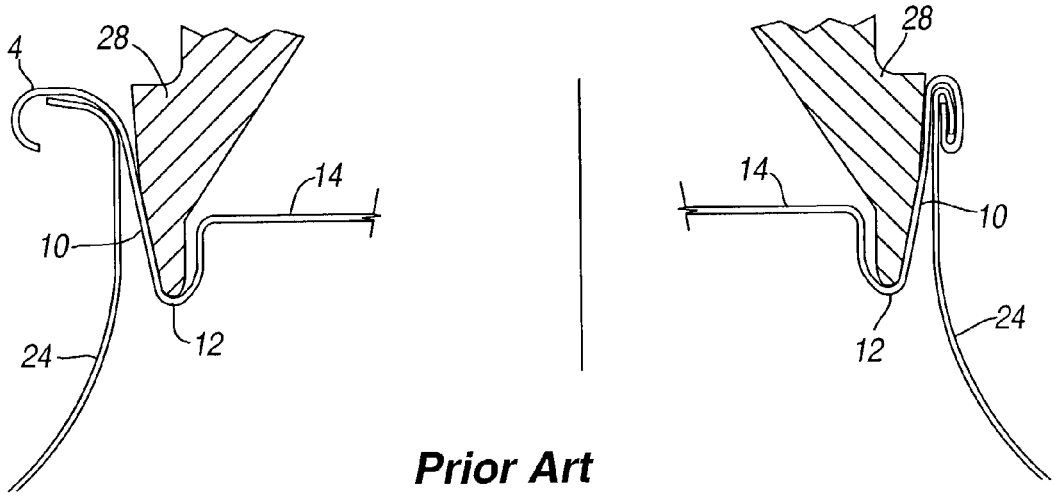
Prior Art FIG. 3A
FIG. 3A is a cross-sectional front elevation view of a prior art beverage can and showing the positioning of the seaming chuck before and after double seaming.

FIG. 3A is a cross-sectional front elevation view of a prior art standard 202 beverage container before and after double seaming. These drawings are provided to show the positioning of the seaming chuck 28 with respect to the end closure 2 before and after double seaming.

Figure 4:
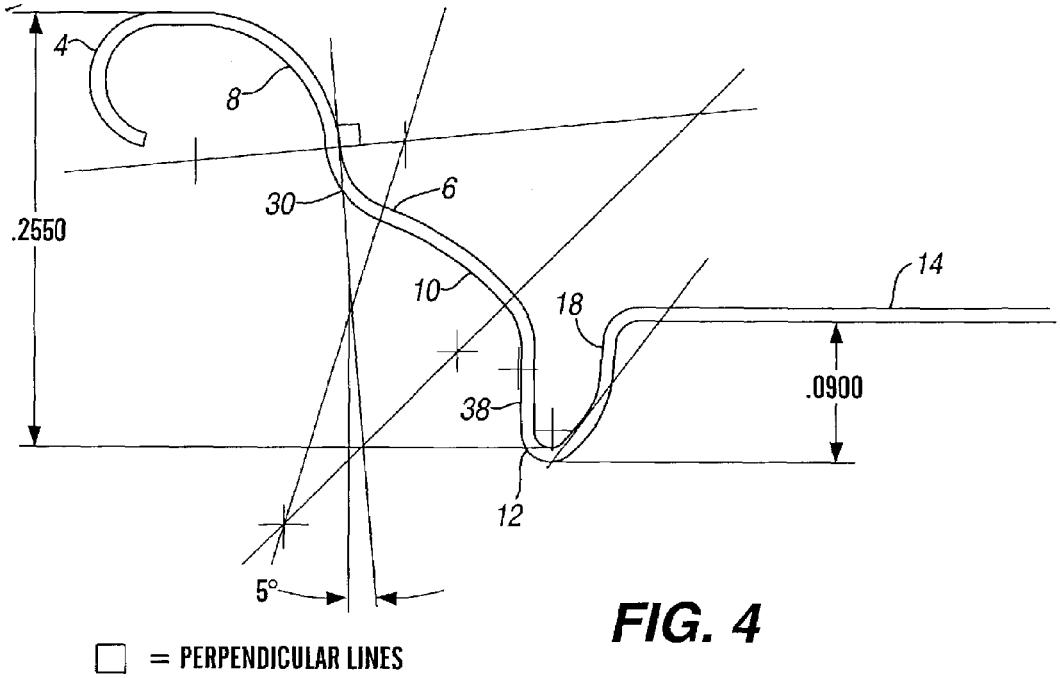
FIG. 4 is a cross-sectional front elevation view of the embodiment of the present invention shown in FIG. 3.
Figure 4A:
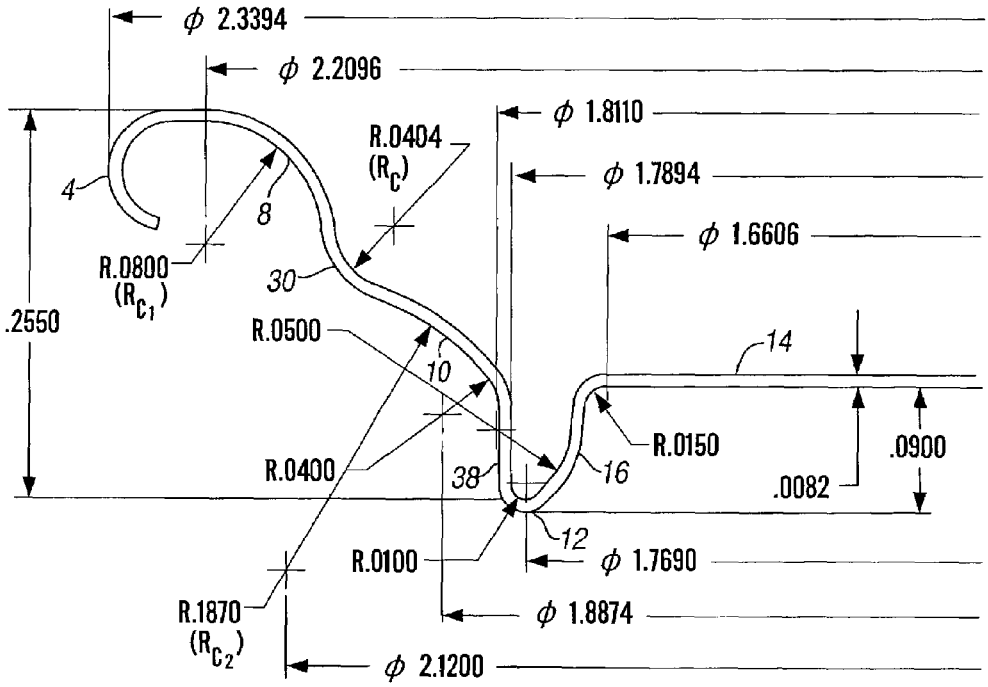
FIG. 4A is a cross-sectional front elevation view of the embodiment of FIG. 4, and further identifying dimensions.

Referring now to FIGS. 4 and 4A, the embodiment of FIG. 3 is shown herein with additional dimensions and which identifies one embodiment of the present invention. The drawing in FIG. 4 identifies the various angles associated with the chuck wall 6, while FIG. 4A depicts the various radius of curvatures associated with the chuck wall 6, the inner panel wall 16, and the various dimensions related thereto. For example, with regard to FIG. 4A and the radius of curvature Rc2. on the lower chuck wall 10 a radius of curvature of 0.187 is defined at a distance of 2.120 inches. The dimension of 2.120 inches represents the diameter extending from one position on the beverage can end and extending across the beverage can end to a corresponding position on the opposing side of the circular shaped beverage can end 2. All other dimensions shown in the drawings have similar representations.

As seen in FIGS. 4 and 4A, there are numerous distinguishing characteristics of this novel beverage can end which are depicted prior to interconnection to a beverage can body. More specifically, in one embodiment the chuck wall 6 is comprised of an upper chuck wall 8 and a lower chuck wall 10 which each having a distinct radius of curvature. For example, the upper chuck wall 8 in this particular example has a radius of curvature Rc1 of 0.080 inches, while the lower radius of curvature Rc2 is 0.187 inches.

The chuck wall arch 30 has a radius of curvature Rc of about 0.0404 inches in this particular embodiment. It should additionally be noted that the central panel 14 has a height no greater than about 0.090 inches from a lowermost portion of the countersink 12, while the distance from the uppermost portion of the circular end wall 4 is about 0.255 inches from the lowermost portion of the countersink 12. Additionally, the central panel 14 has a total diameter no greater than about 1.661 inches in this particular embodiment.

As seen in FIG. 3, once the beverage can end of FIG. 4 is double seamed to a beverage can body 24, the geometry of the upper chuck wall 8 is modified, but the dimensions identified in FIGS. 4 and 4A from the chuck wall arch 30 and extending downwardly will remain substantially the same. Additionally, for purposes of reference, the upper chuck wall radius of curvature is defined herein as "Rc1", while the lower chuck wall radius of curvature is shown as "Rc2". As appreciated by one skilled in the art, the radius of curvatures Rc1 and Rc2 of the upper chuck wall 8 and lower chuck wall 10 respectively, may vary as shown in additional embodiments discussed hereinbelow, or may have slight or moderate radius of curvatures as depicted in the drawings.

Figure 4B:
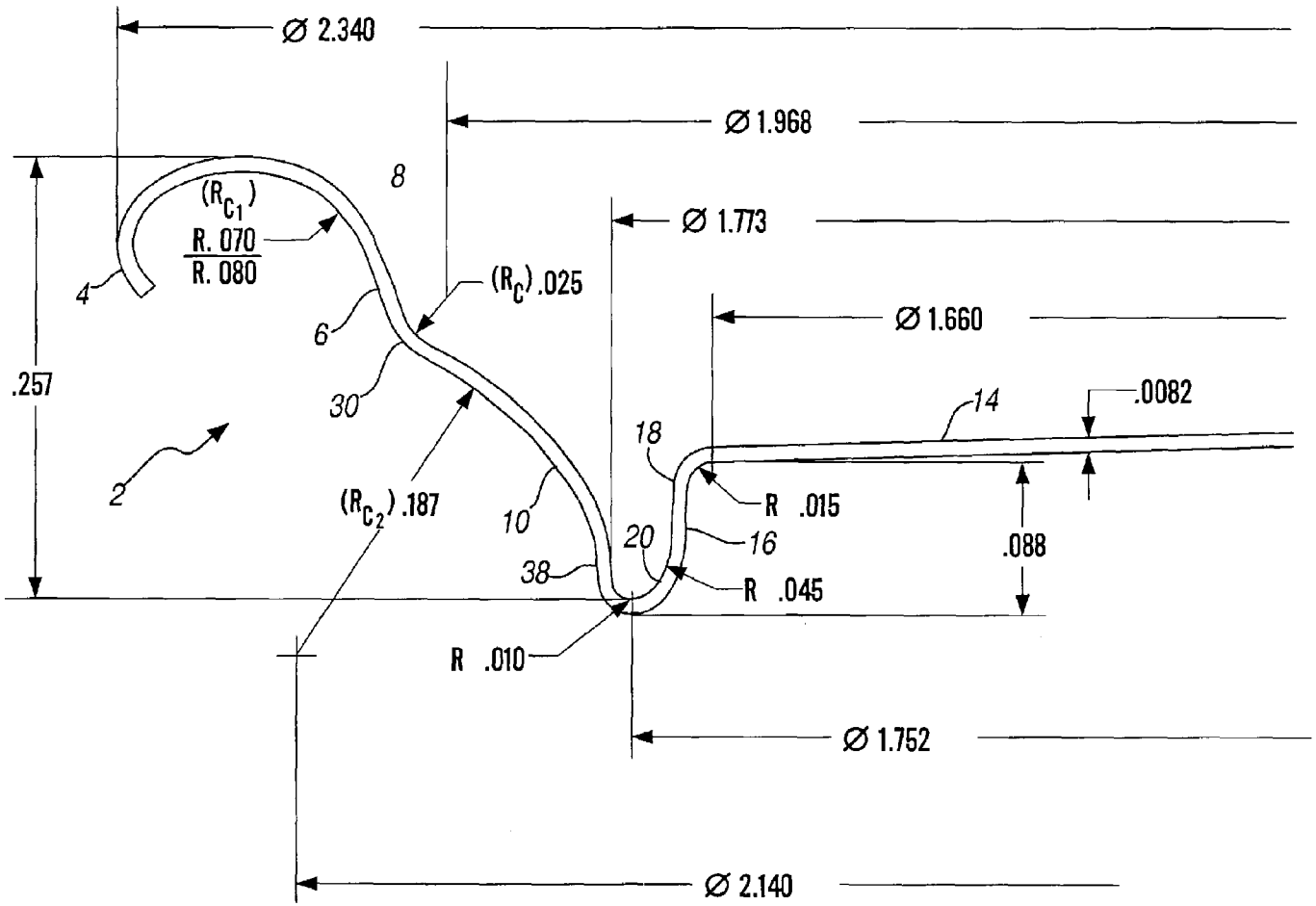
FIG. 4B is a cross-sectional front elevation view of an alternative embodiment of the present invention.
Figure 4C:
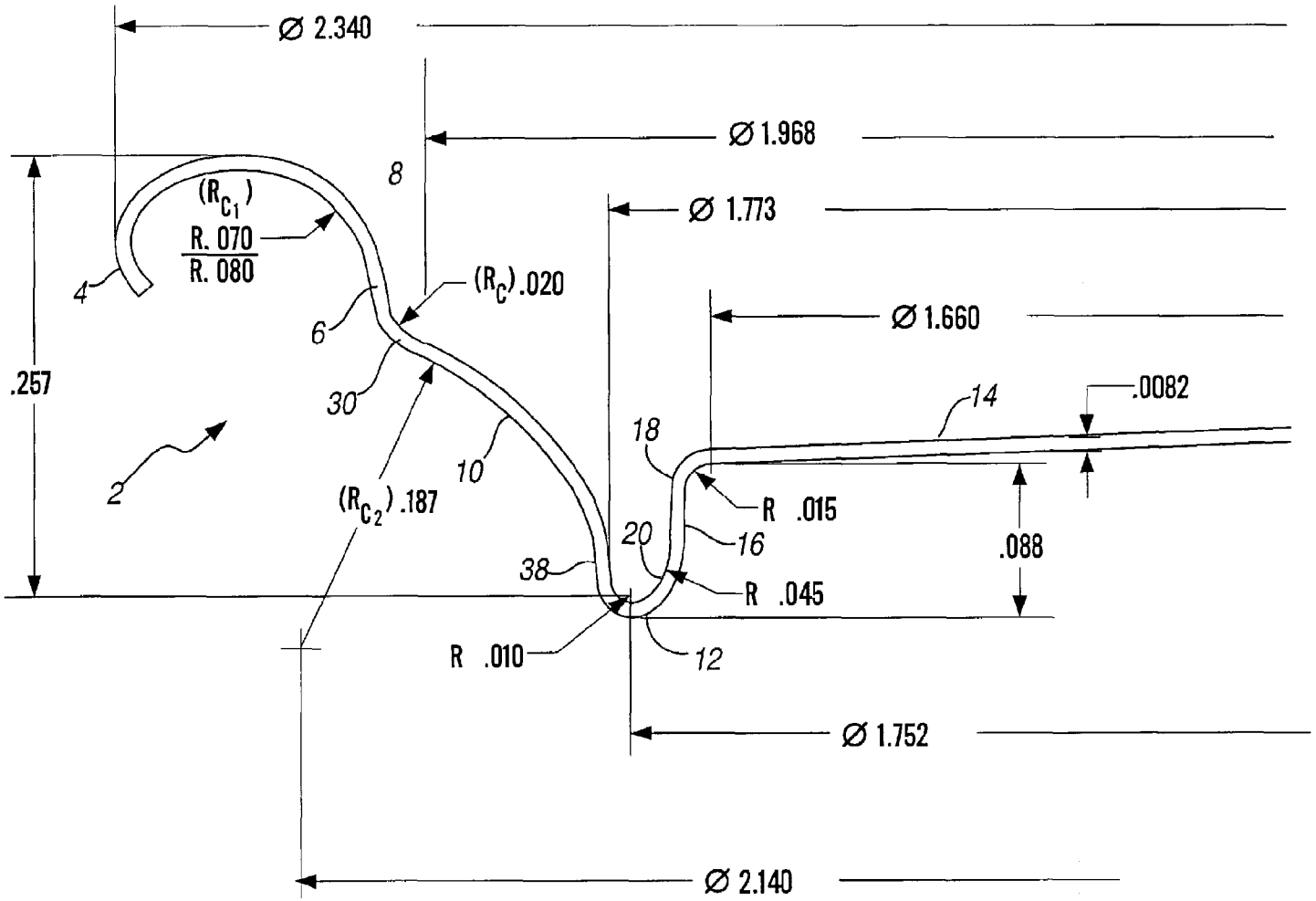
FIG. 4C is a cross-sectional front elevation view of an alternate embodiment of the present invention.

Referring now to FIGS. 4B and 4C, two preferred embodiments of the present invention are provided herein. More specifically, in FIG. 4B the chuck wall arch 30 has a radius of curvature Rc of 0.025, while in FIG. 4C the chuck wall arch has a radius of curvature Rc of 0.020. Both of these embodiments have been found to have excellent double seaming and strength properties.

Figure 5:
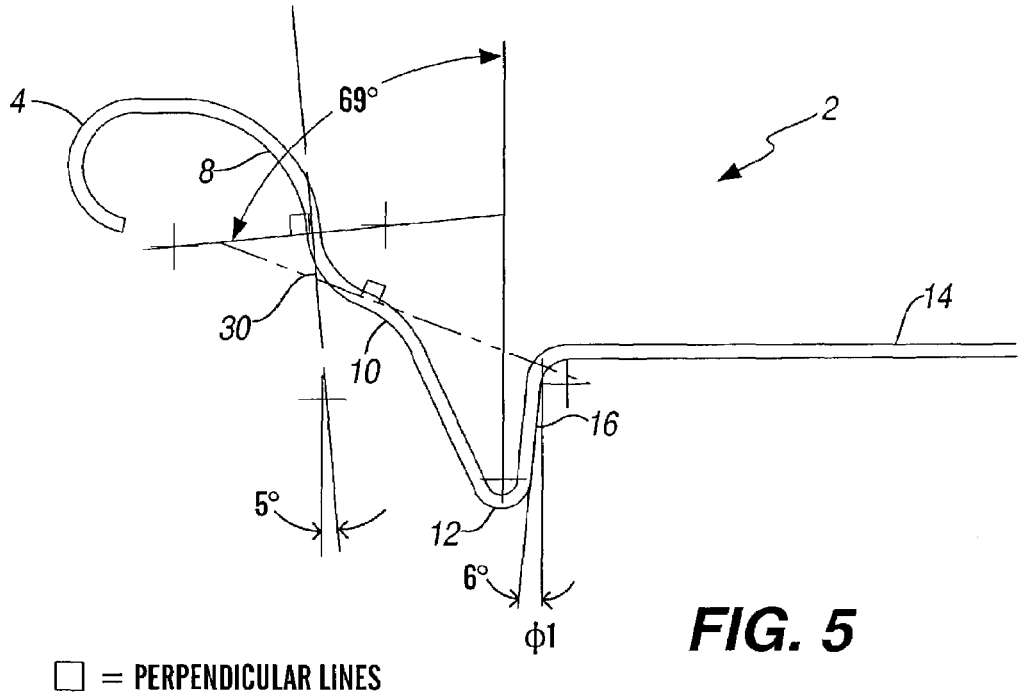
FIG. 5 is a cross-sectional front elevation view of an alternative embodiment of the present invention.
Figure 5A:
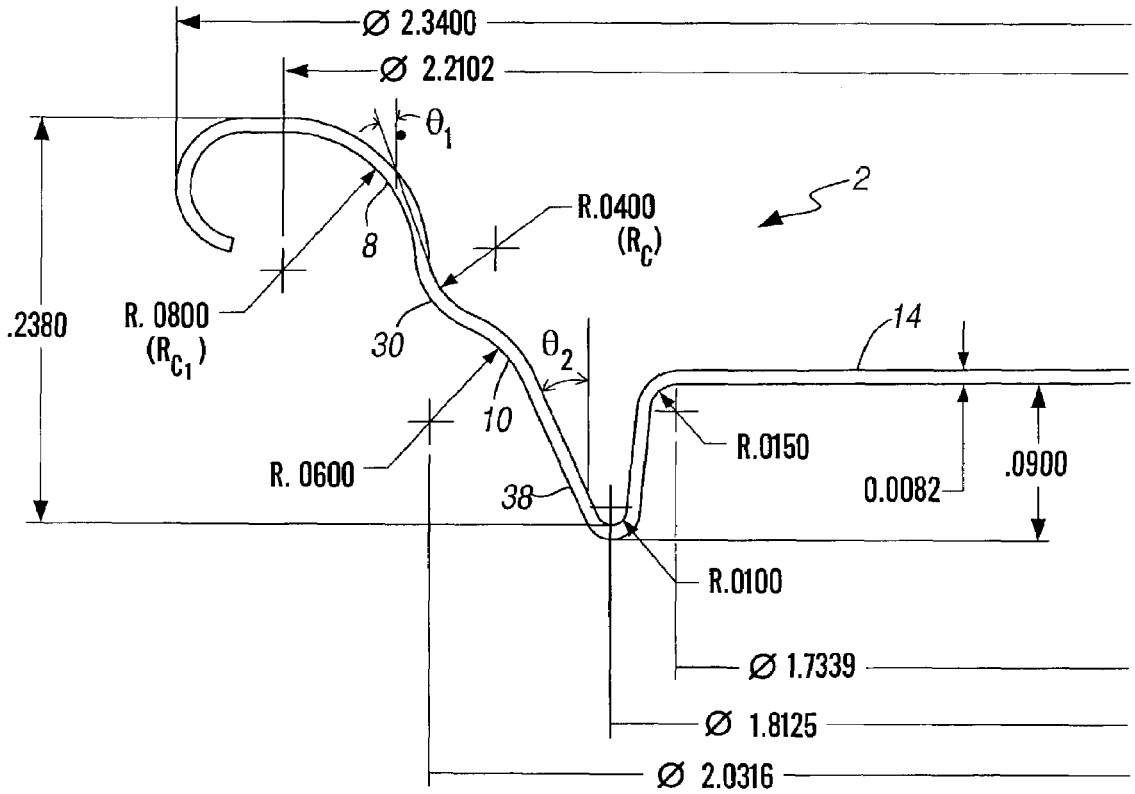
FIG. 5A is a cross-sectional front elevation view of the embodiment of FIG. 5 and further identifying dimensions.
Figure 5B:
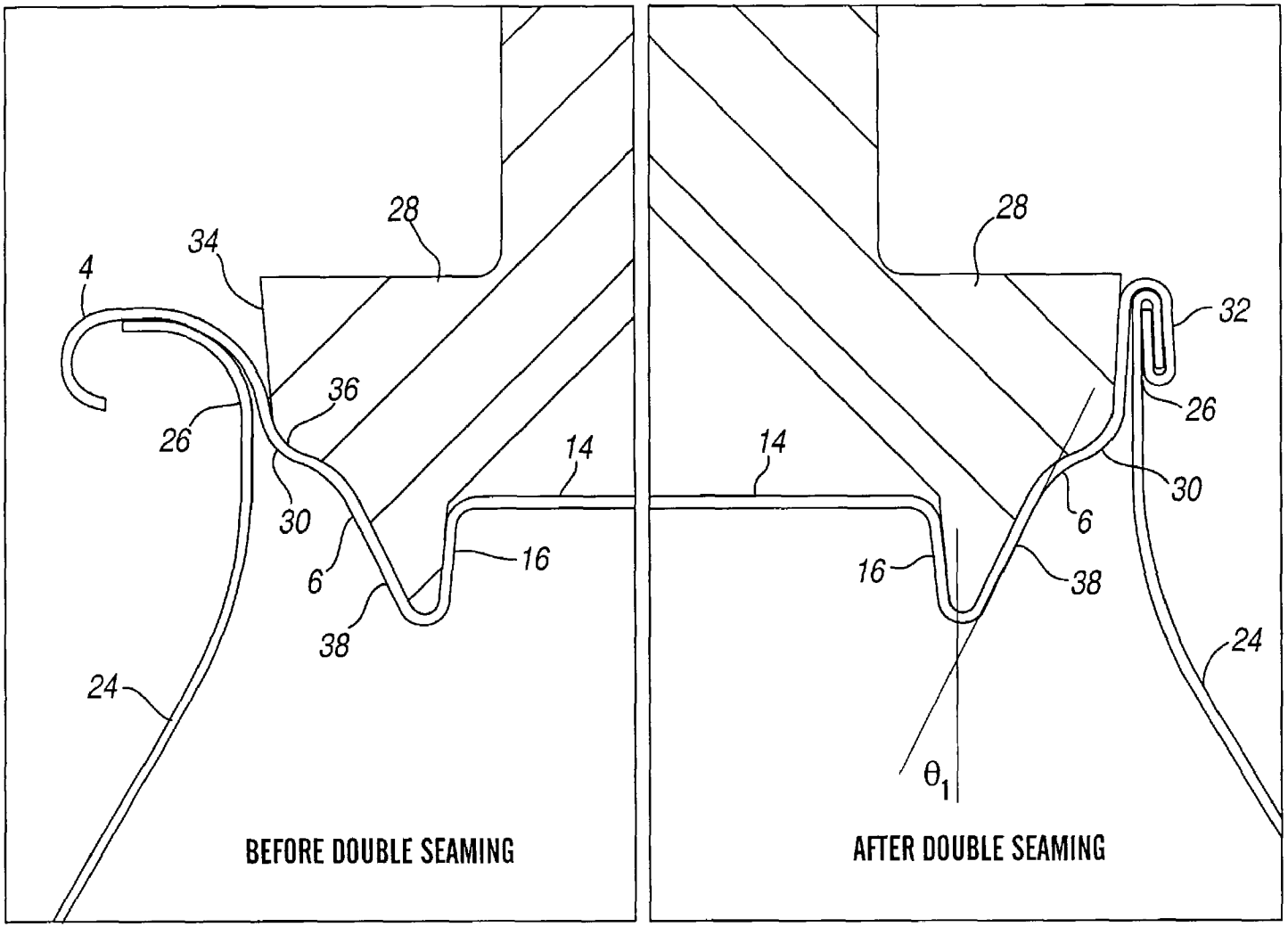
FIG. 5B is a cross-sectional view of the embodiment shown in FIGS. 5 and 5A before and after double seaming to a beverage can body.

Referring now to FIGS. 5, 5A and 5B, an alternative embodiment of the present invention is identified herein, wherein the lower chuck wall 10 is substantially linear, and does not have a pronounced radius of curvature. However, the chuck wall arch 30, which extends downward and toward the beverage can neck 26 has a radius of curvature Rc of about 0.040 inches, while the upper chuck wall 10 has a radius of curvature Rc1. of about 0.080 inches. Additionally, in this particular embodiment the inner panel wall 16 is substantially linear and extends upwardly at an angle of between about 2° and 8°, and more preferably 6° as measured from a hypothetical vertical plane. Additionally, the upper chuck wall 8 has an angle $\theta_1$ of about 8–15° and the lower chuck wall 10 has an angle $\theta_2$ between about 20–35°, although variations of these chuck wall angles may be utilized as appreciated by one skilled in the art. FIG. 5B shows the embodiment of FIG. 5 just before and after double seaming to the beverage can body.

Figure 6:
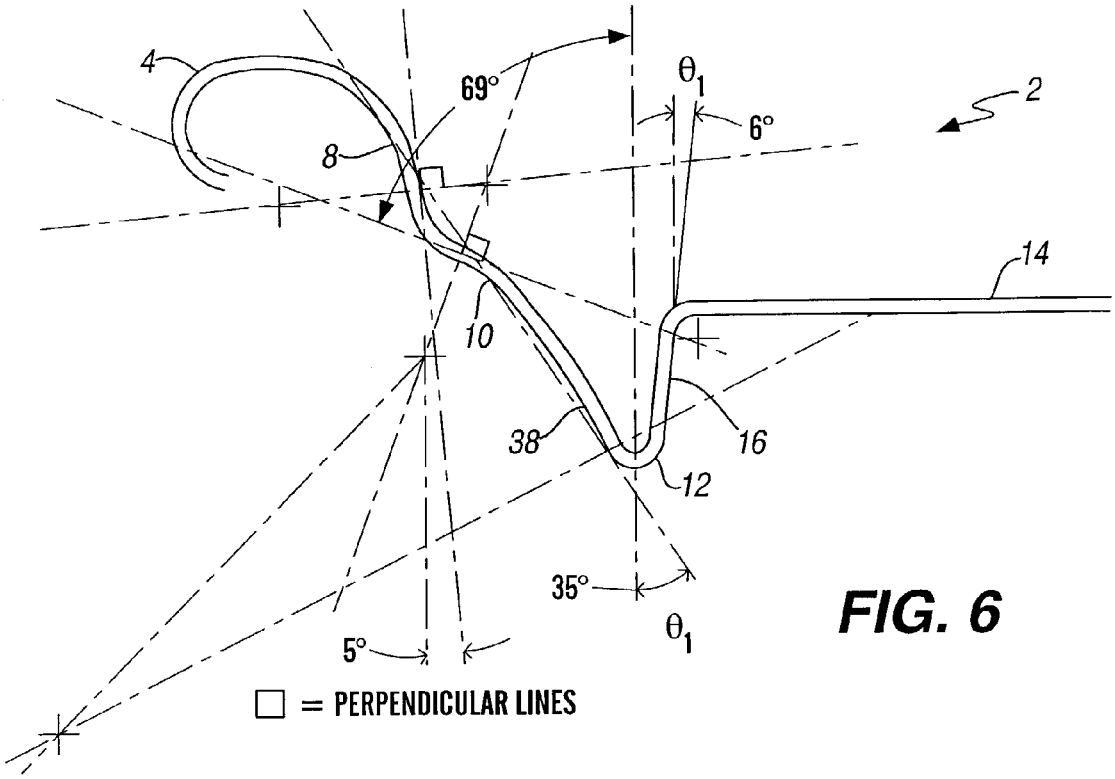
FIG. 6 is a cross-sectional front elevation view of an alternative embodiment of the present invention.
Figure 6A:
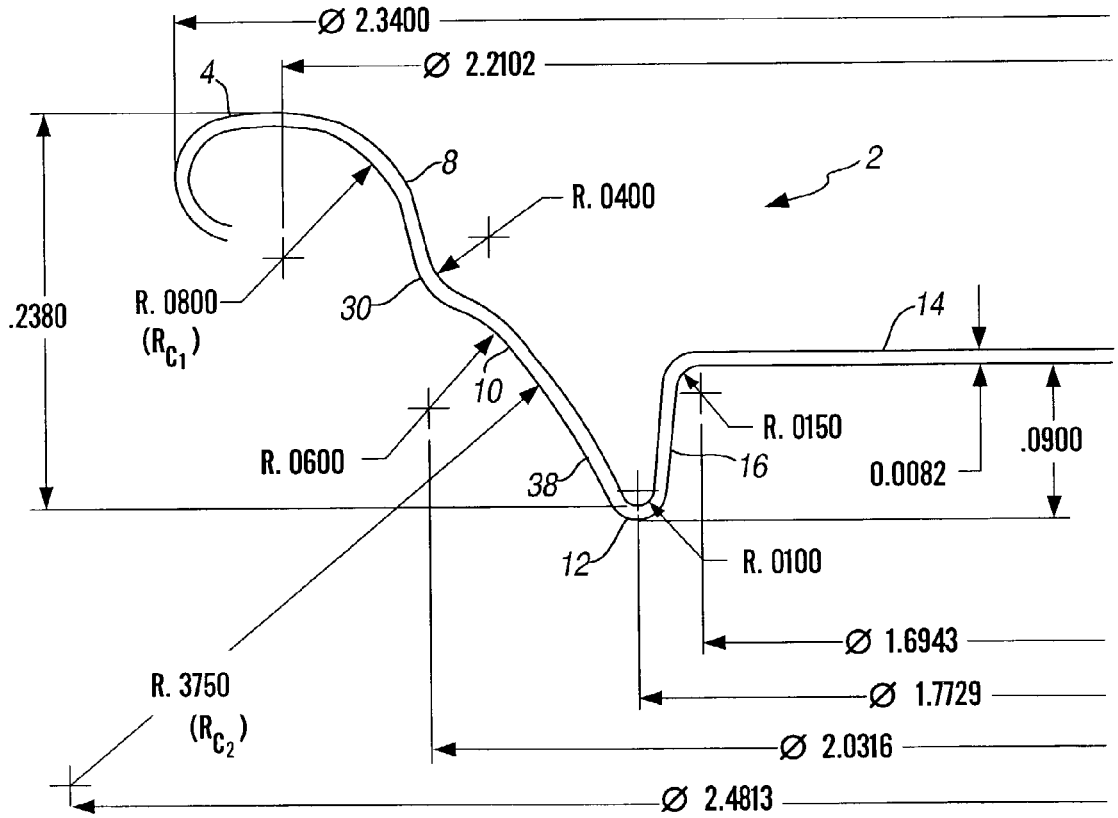
FIG. 6A is a cross-sectional front elevation view of the embodiment of FIG. 6 and further identifying dimensions.
Figure 6B:
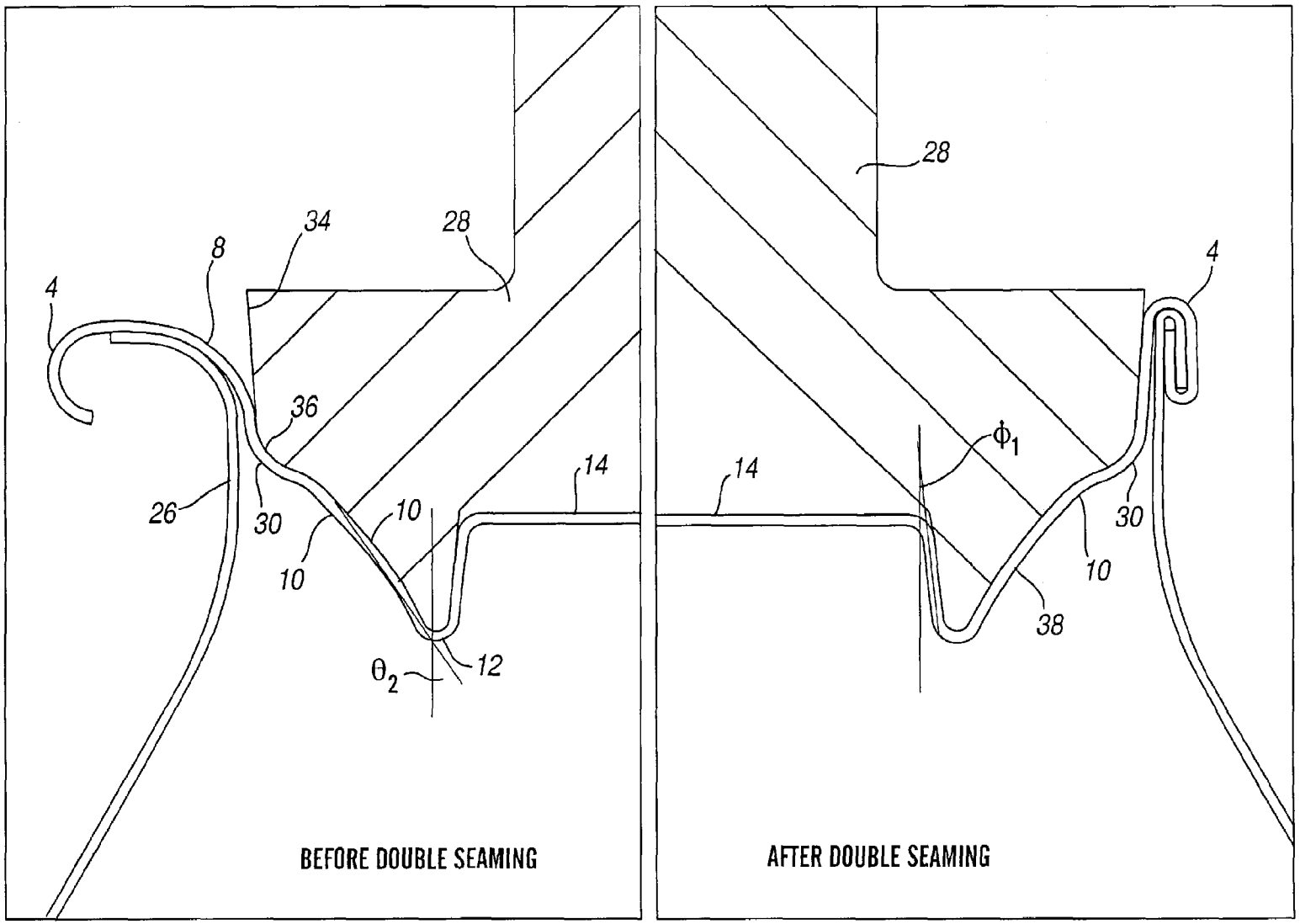
FIG. 6B is a cross-sectional front elevation view of the embodiment shown in FIGS. 6 and 6A before and after double seaming to a beverage can body.

Referring now to FIGS. 6, 6A and 6B, another embodiment of the present invention is provided herein with different angles of the chuck wall 6 and inner panel wall 16. In this particular embodiment, a substantially linear inner panel wall 16 is provided which has an angle $\phi_1$ of between about 0 and 8%, and more specifically 6%. Additionally, the chuck wall 6 is comprised of an upper chuck wall 8, lower chuck wall 10 and a chuck wall arch 30 positioned therebetween, and having a radius or curvature Rc of about 0.040 inches. The lower chuck wall 10 has a radius of curvature Rc2 of about 0.375 inches as measured from a point of reference with a diameter of 2.481 inches, while the upper chuck wall 8 has a radius of curvature Rc1 of 0.080 inches and a center point having a diameter of 2.210 inches as shown therein in the drawings. Additionally, the countersink 12 has a total depth of about 0.238 inches as measured from an uppermost portion of the circular end wall 4, while the central panel 14 is positioned at a height no greater than about 0.090 inches from a lowermost portion of the countersink 12.

Figure 7:
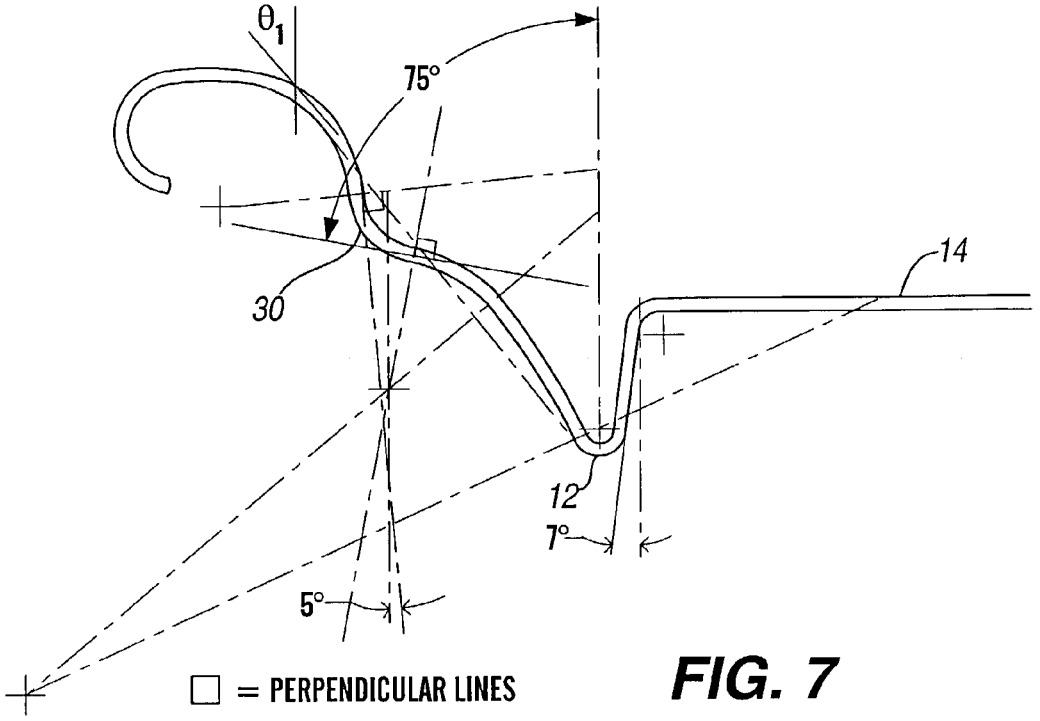
FIG. 7 is a cross-sectional front elevation view of an alternative embodiment of the present invention.
Figure 7A:
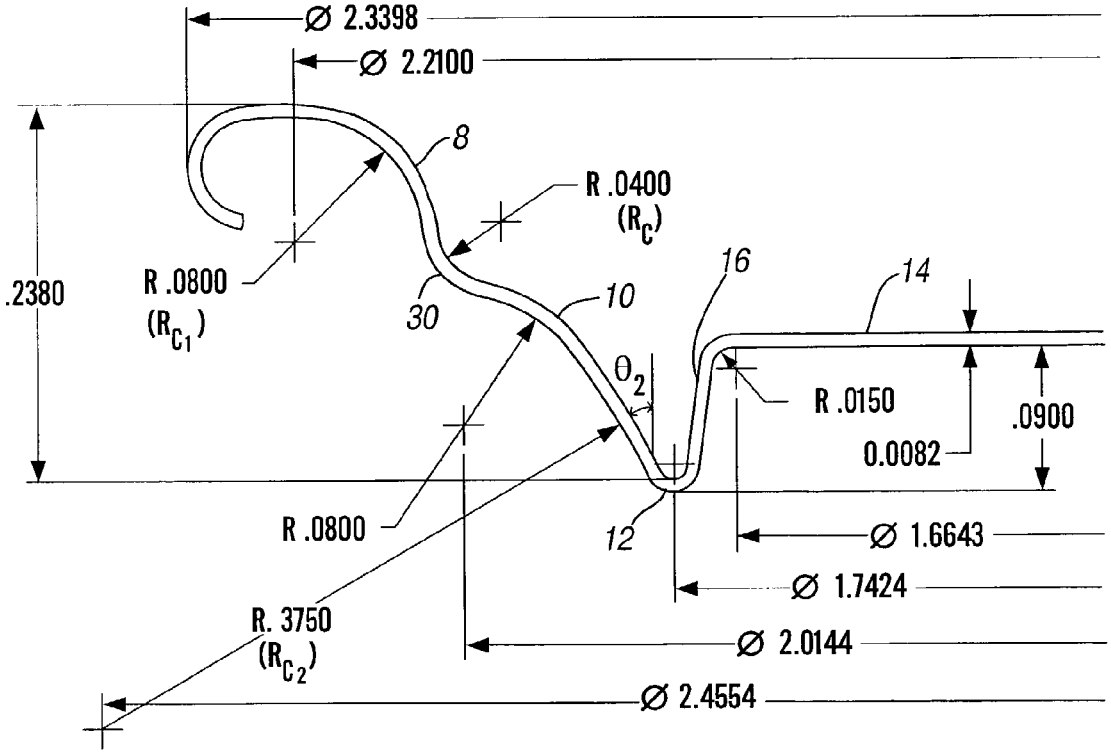
FIG. 7A is a cross-sectional front elevation view of the embodiment of FIG. 6 and further identifying dimensions.
Figure 7B:
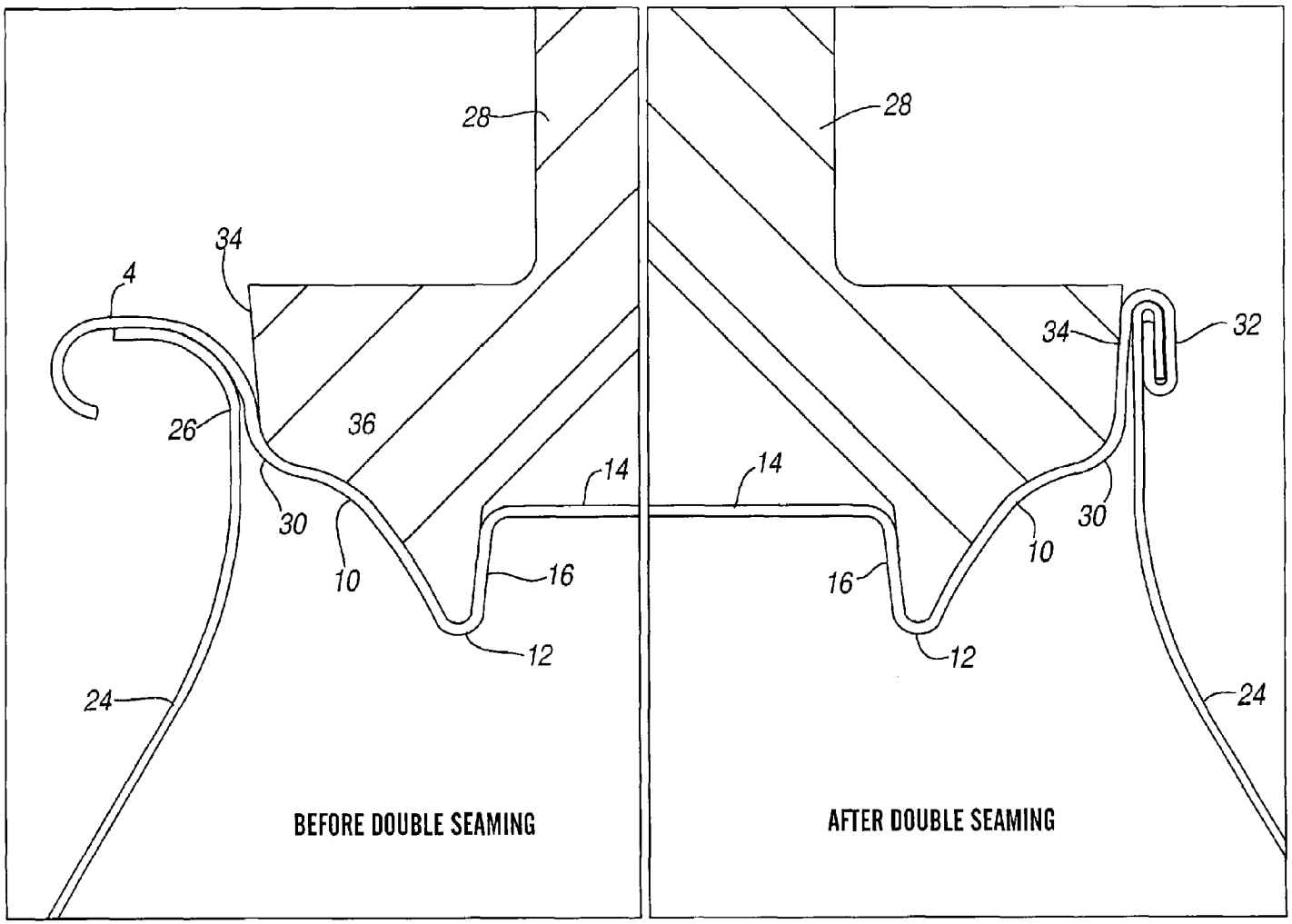
FIG. 7B is a cross-sectional view of the embodiment shown in FIGS. 7 and 7A before and after double seaming.

Referring now to FIGS. 7, 7A and 7B, another embodiment of the present invention is provided herein and providing specific angles of the chuck wall 6, inner panel wall 16, as well as the radius of curvatures of the upper chuck wall 8 and lower chuck wall 10. As identified in FIG. 7, the inner panel wall 16 extends upwardly at an angle of about 7°, while the lower chuck wall 10 extends downwardly at an angle $\theta_1$, of about 32°. The chuck wall arch 30 has a radius of curvature Rc of about 0.040 inches, while the lower chuck wall 10 has a radius of curvature Rc2 of 0.375 inches measured at a diameter of 2.455 inches, while the upper chuck wall 8 has a radius of curvature Rc1 of 0.080 inches at a point of reference having a diameter of 2.210 inches. Additionally, the point of intersection between the inner panel wall 16 and the central panel 14 has a radius of curvature of about 0.015 inches as measured at a point or reference of 1.664 inches. FIG. 7B shows the embodiment of FIG. 7 before and after double seaming the beverage can end to the beverage can body.

Figure 8:
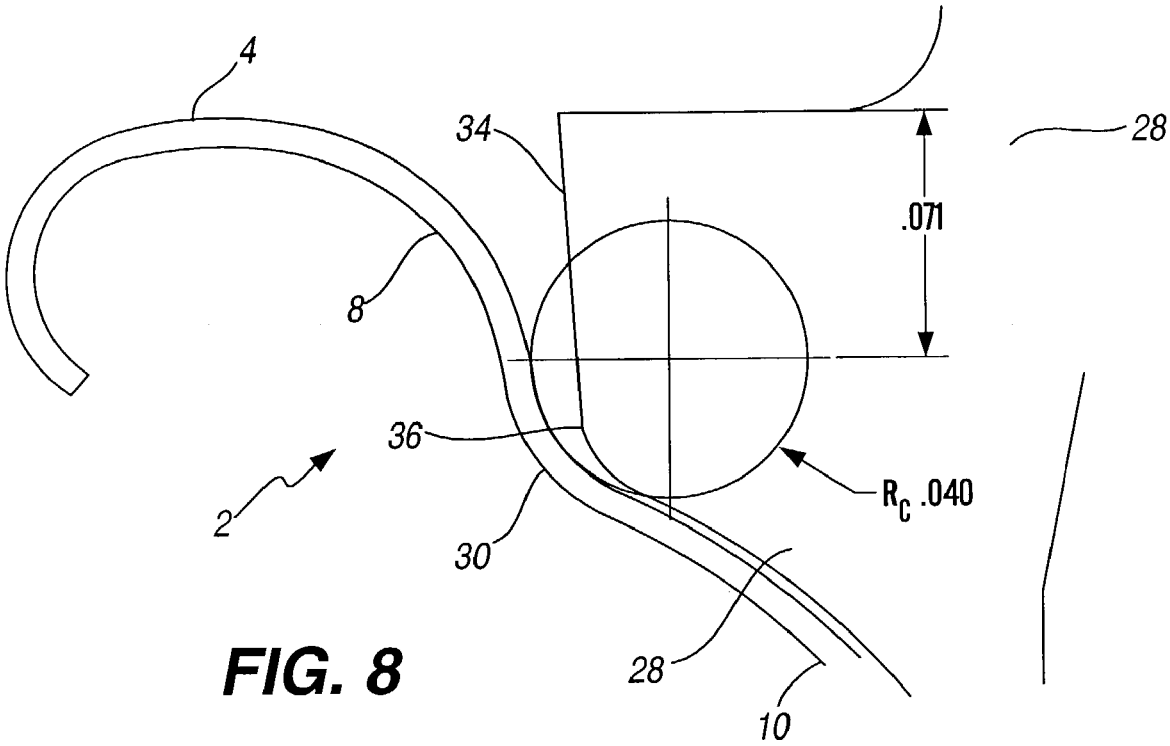
FIG. 8 is a cross-sectional view of one embodiment of the present invention prior to double seaming and identifying the specific radius of curvature of the chuck wall arch.
Figure 8A:
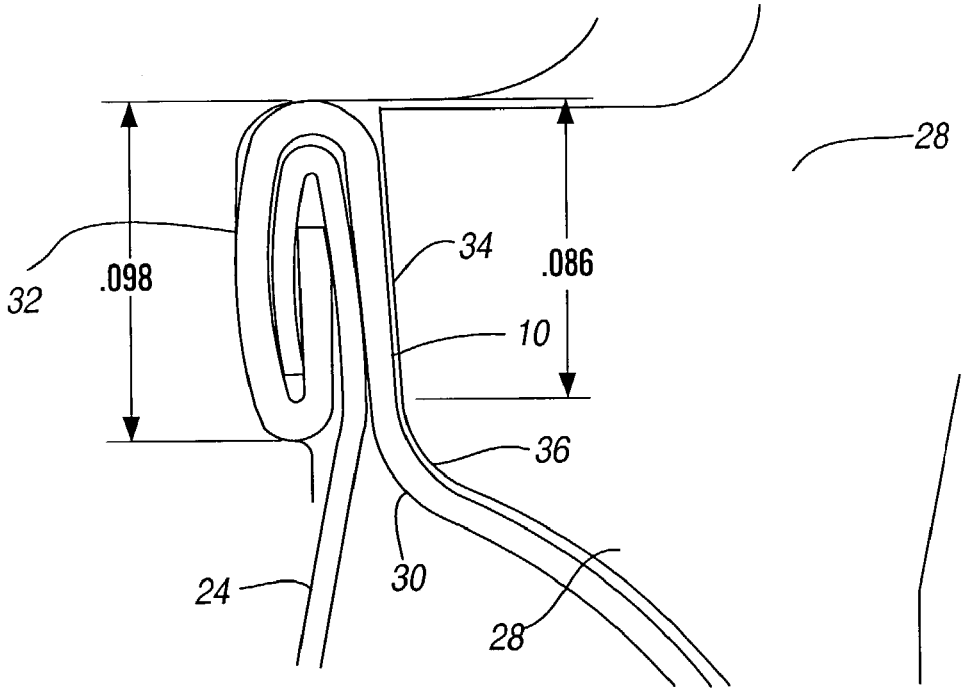
FIG. 8A is a cross-sectional view of the embodiment shown in FIG. 8 after double seaming, and identifying the length of the upper chuck wall positioned above the arch with respect to the length of the double seam and the positioning of the seaming chuck.
Figure 9:
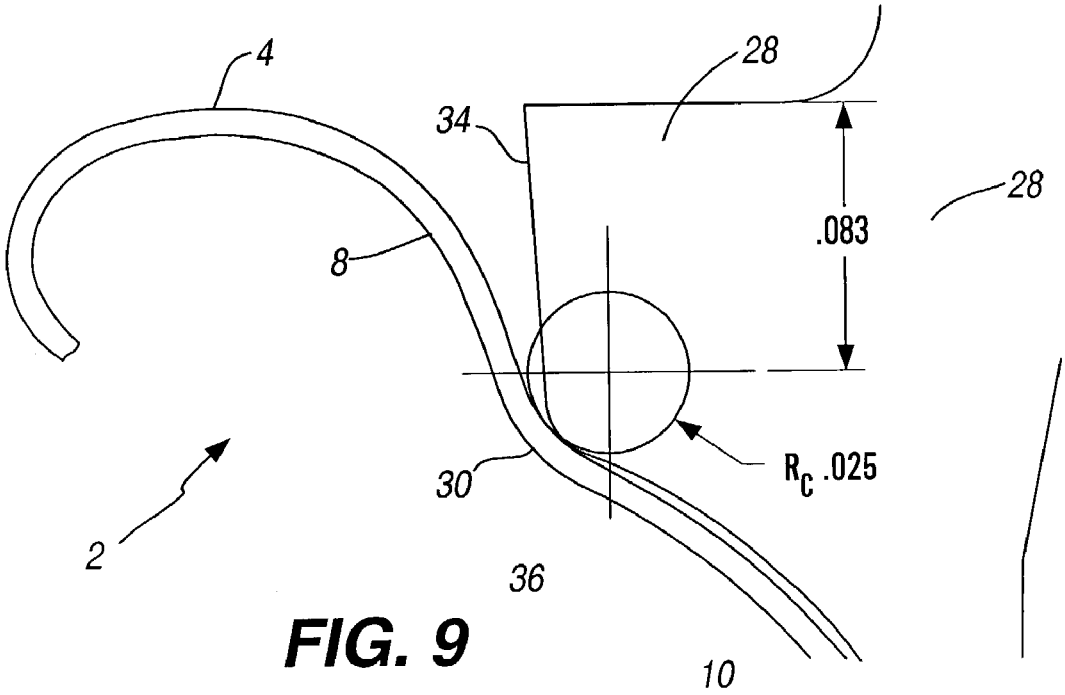
FIG. 9 is a cross-sectional view of one embodiment of the present invention prior to double seaming and identifying the specific radius of curvature of the chuck wall arch.
Figure 9A:
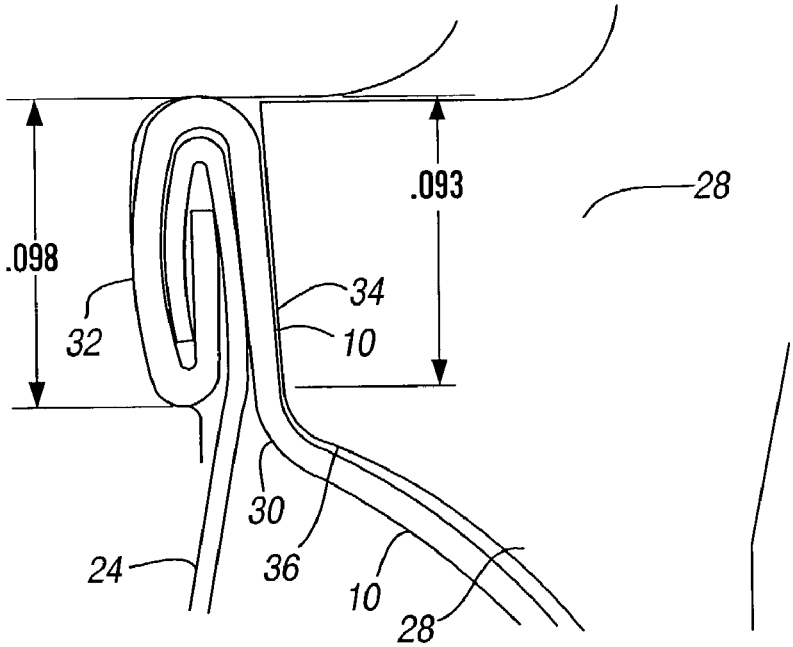
FIG. 9A is a cross-sectional view of the embodiment shown in FIG. 8 after double seaming, and identifying the length of the upper chuck wall positioned above the arch with respect to the length of the double seam and the positioning of the seaming chuck.
Figure 10:
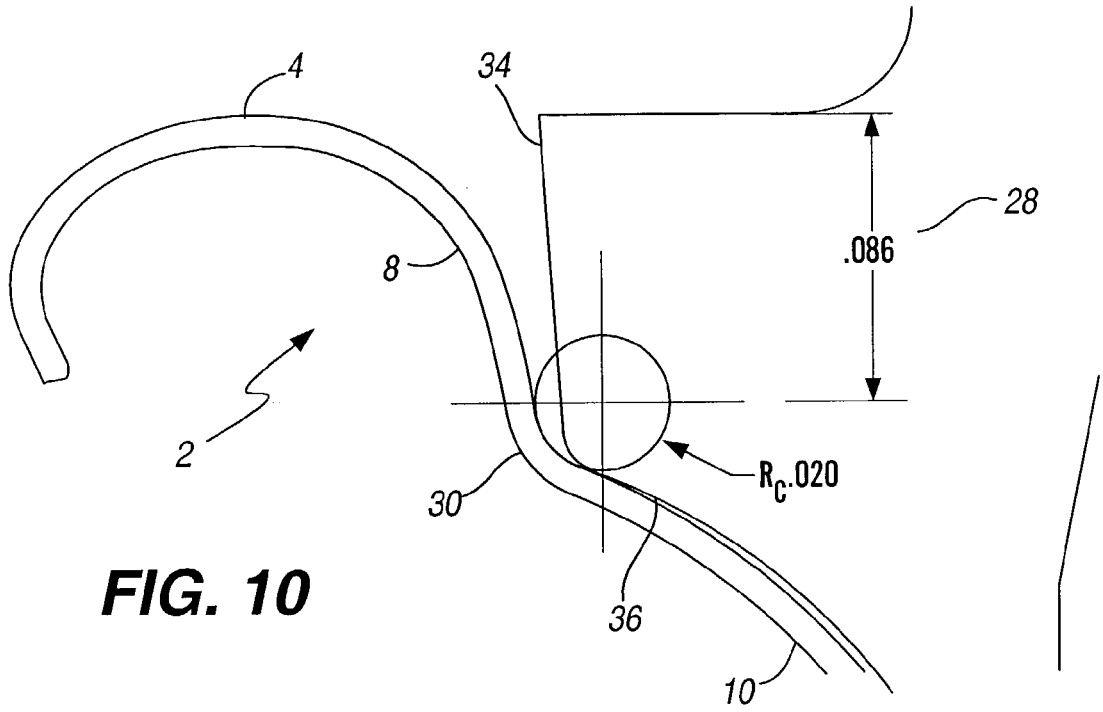
FIG. 10 is a cross-sectional view of one embodiment of the present invention prior to double seaming and identifying the specific radius of curvature of the chuck wall arch.
Figure 10A:
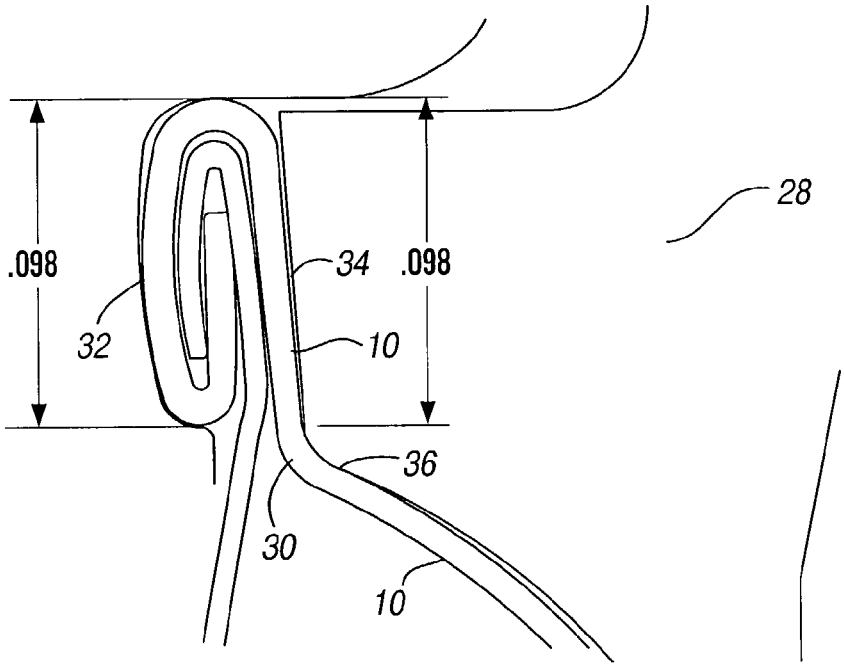
FIG. 10A is a cross-sectional view of the embodiment shown in FIG. 8 after double seaming, and identifying the length of the upper chuck wall positioned above the arch with respect to the length of the double seam and the positioning of the seaming chuck.

Referring now to FIGS. 8–10A, cross-sectional front elevation views are provided for three different embodiments of the present invention. More specifically, FIGS. 8–8A depict a container end closure where the outwardly projecting arch in the chuck wall 30 has a radius of curvature of 0.040 inches, while FIGS. 9–9A depict an arch 30 with a radius of curvature of 0.025 inches, and FIGS. 10–10A depicts an outwardly projecting arch 30 with a radius of curvature of 0.020 inches.

As depicted in FIG. 8, when utilizing an outwardly extending arch with a radius of curvature of 0.040 inches, the radius is initiated at a location which is 0.071 inches from the upper edge of the circular end wall 4. In this embodiment, and as shown in FIG. 8A, the upper chuck wall 8 has a linear portion of 0.086 inches, which is less than the 0.098 inch length of the double seam and which corresponds to the seaming chuck linear wall portion 34. During testing, this end closure geometry has shown a greater propensity for leaking as opposed to the preferred embodiments of FIGS. 9–9A, and more preferably FIGS. 10–10A, where the linear portion of the upper chuck wall 8 is at least about as long as the length of the double seam, i.e., 0.098 inches.

Thus, as shown in FIG. 9–9A, an outwardly extending arch 30 with a radius of curvature of 0.083 inches is shown, which utilizes a seaming chuck 28 with a linear portion of 0.093 inches, and which is slightly shorter than the 0.098 double seam 32 created by the interconnection of the beverage can neck 26 and the circular end wall 4 of the beverage can end closure 2.

Referring now to FIGS. 10–10A, a preferred embodiment of the present invention is shown herein, where the outwardly extending arch 30 has a radius of curvature of 0.020 inches, and is positioned 0.086 inches below the upper edge of the circular end wall 4 prior to double seaming. As shown in FIG. 10A, in this embodiment a seaming chuck 28 with a liner wall portion 34 with a length of 0.098 inches is utilized, which is equivalent to the double seam length of 0.098 inches.

With regard to each of the various embodiments discussed herein, and as identified in FIGS. 1–10A, the improved strength characteristics and reduced costs associated with the beverage can ends are obtained based on the geometric configurations, as well as the metallic properties and specific gauge thickness associated therewith. More specifically, the metallic materials are generally comprised of aluminum, and more commonly aluminum alloys and temper such as 5182H119, 5182H481 and 5182C515, which are commonly known in the art. With regard to the thickness of these aluminum alloys, typically a gauge of between about 0.0080 and 0.0095 are utilized, with greater thicknesses required for larger diameter beverage cans. Thus, a 202 beverage can end may utilize aluminum materials with thicknesses between about 0.0080 and 0.0090 gauge, while a 206 beverage can end may utilize an aluminum alloy material with a thickness between about 0.0085 and 0.0095 gauge. Thus, in one embodiment of the present invention a 5182H19 aluminum alloy material having a thickness of between about 0.0080 and 0.0085 gauge provides significant cost savings and strength in a 202 sized aluminum beverage can end with the geometric properties defined herein. For clarity, the following list of components and associated numbering found in the drawings are provided herein:

| No. | Components |
|---|---|
| 2 | Container end closure |
| 4 | Circular end wall |
| 6 | Chuck wall |
| 8 | Upper chuck wall |
| 10 | Lower chuck wall |
| 12 | Countersink |
| 14 | Central panel |
| 16 | Inner panel wall |
| 18 | Inner panel wall upper end |
| 20 | Inner panel wall lower end |
| 22 | Crown |
| 24 | Container body |
| 26 | Container neck |
| 28 | Seaming chuck |
| 30 | Chuck wall arch |
| 32 | Double seam |
| 34 | Seaming chuck linear wall portion |
| 36 | Seaming chuck arcuate wall portion |
| 38 | Countersink outer panel wall |
| Rc | Chuck wall arch radius of curvature |
| Rc1 | Upper chuck wall radius of curvature |
| Rc2 | Lower chuck wall radius of curvature |
| $\theta_1$ | Upper chuck wall angle |
| $\theta_2$ | Lower chuck wall angle |
| $\phi_1$ | Upper inner panel wall angle |
| $\phi_2$ | Lower inner panel wall angle |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A container end closure adapted for interconnection to a container body, comprising:

a circular end wall adapted for interconnection to a side wall of said container body;

a chuck wall comprising an upper end integrally interconnected to said circular end wall and a lower end extending downwardly at an angle of at least about 8 degrees as measured from a vertical plane, said lower end having an outwardly extending arch having a radius of curvature of between about 0.020 and 0.220 inches with a center point positioned below said circular end wall and an upper chuck wall portion having a radius of curvature between about 0.070–0.090 inches;

a countersink interconnected to a lower portion of said chuck wall and having a radius of curvature less than about 0.015 inches, wherein said lower end of said chuck wall extends downwardly proximate to a lower portion of said countersink;

an inner panel wall interconnected to said countersink and extending upwardly at an angle of between about 0 degrees and 15 degrees as measured from a substantially vertical plane; and a central panel interconnected to an upper end of said inner panel wall and raised above a lowermost portion of said countersink at least about 0.080 inches wherein said central panel is positioned above said lower end of said chuck wall.

2. The container end closure of claim 1, wherein said central panel has a depth of at least about 0.150 inches from an uppermost portion of said circular end wall.

3. The container end closure of claim 1, wherein said end closure is constructed of a metallic material having a thickness no greater than about 0.0090 inches.

4. The container end closure of claim 1, wherein the interconnection of said central panel and said inner panel wall has a radius of curvature no greater than about 0.015 inches.

5. The container end closure of claim 1, wherein said central panel diameter is less than about 75% of a diameter of said circular end wall.

6. The container end closure of claim 1, wherein said end closure is comprised of an aluminum alloy.

7. The container end closure of claim 1, wherein said inner panel wall is non-linear.

8. The container end closure of claim 7, wherein said inner panel wall has at least one radius of curvature between about 0.030 inches and 0.070 inches.

9. A container end closure, comprising:

a circular end wall adapted for interconnection to a side wall of a container;

a non-linear chuck wall integrally interconnected to said circular end wall and extending downwardly, said chuck wall comprising an outwardly extending arch having a radius of curvature between about 0.170 inches and 0.300 inches and a non-linear upper chuck wall portion positioned above said outwardly extending arch with a radius of curvature between about 0.070 and 0.090 inches;

a countersink interconnected on a first end to a lower portion of said chuck wall and on a second end to a lower portion of an inner panel wall and having a radius of curvature less than about 0.0 15 inches, wherein said lower portion of said chuck wall extends substantially to a non-linear portion of said countersink; and a central panel interconnected to an upper end of said inner panel wall and raised above a lowermost portion of said countersink no greater than about 0.090 inches, said central panel positioned above said lower portion of said chuckwall.

10. The container end closure of claim 9, wherein at least a part of said inner panel wall is comprised of a non-linear portion.

11. The container end closure of claim 9, wherein said central panel has a diameter less than about 75 percent of the diameter of said circular end wall.

12. A metallic container end closure adapted for interconnection to a container body, comprising:

a peripheral end wall adapted for interconnection to a side wall of the container body;

an upper chuck wall portion integrally interconnected to said peripheral end wall and having a radius of curvature of at least about 0.070 inches;

an inwardly projecting arch integrally interconnected to said upper chuck wall and having a radius of curvature of at least about 0.015 inches;

a lower chuck wall portion integrally interconnected to said inwardly projecting arch and having a radius of curvature of at least about 0.150 inches;

a countersink integrally interconnected to said lower chuck wall portion on a first end and a lower end of an inner panel wall on a second end, said inner panel wall extending upwardly and comprising a lower portion oriented at a first angle and an upper portion oriented at a second angle which is distinct from said second angle; and a central panel interconnected to an upper end of said inner panel wall, said central panel positioned above a lowermost portion of said countersink a distance no greater than about 0.090 inches.

13. The metallic container end closure of claim 12, wherein said inner panel wall and said outer panel wall of said countersink are separated by a distance of no greater than about 0.054 inches.

* * * * *